US005405738A

United States Patent [19]

Uchida

[11] Patent Number: 5,405,738

[45] Date of Patent: Apr. 11, 1995

[54] SILVER HALIDE PHOTOGRAPHIC LIGHT-SENSITIVE MATERIAL

[75] Inventor: Mitsuhiro Uchida, Minami-Ashigara, Japan

[73] Assignee: Fuji Photo Film Co., Ltd., Kanagawa, Japan

[21] Appl. No.: 73,040

[22] Filed: Jun. 8, 1993

[30] Foreign Application Priority Data

Jun. 8, 1992 [JP] Japan ..... 4-171551

[51] Int. Cl.[6] ..... G03C 1/035

[52] U.S. Cl. ..... 430/567; 430/570; 430/599; 430/627; 430/630

[58] Field of Search ..... 430/567, 569, 627, 630, 430/570, 599

[56] References Cited

U.S. PATENT DOCUMENTS

| | | | |
|---|---|---|---|
| 4,496,652 | 1/1985 | Haugh et al. | 430/567 |
| 4,874,687 | 10/1989 | Itabashi | 430/567 |
| 4,973,548 | 11/1990 | Chang | 430/567 |
| 5,132,201 | 7/1992 | Yagahara et al. | 430/264 |
| 5,187,058 | 2/1993 | Inoue | 430/567 |

FOREIGN PATENT DOCUMENTS 55-124139 9/1980 Japan .
62-229132 10/1987 Japan .
3121442 5/1991 Japan .

OTHER PUBLICATIONS

Tadaaki Tani, Photographic Effects of Electron and Positive Hole Traps in Silver Halides VIII: Dependence of Desensitizations by Dyes upon Crystal Habit and Size of Silver Bromide Grains, *Society of Photographic Scientists and Engineers,* 18, 215–226 (1974).

Patent Abstracts of Japan, unexamined applications, P section, vol. 12, No. 95, Mar. 29, 1988, The Patent Office Japanese Government, p. 101 P 681, No. 62-229 132 (Konishiroku Photo Ind Co Ltd).

*Primary Examiner*—Janet C. Baxter
*Attorney, Agent, or Firm*—Sughrue, Mion, Zinn, Macpeak & Seas

[57] ABSTRACT

A silver halide photographic light-sensitive material has at least one silver halide emulsion layer on a support. The silver halide emulsion layer contains a silver halide emulsion in which 50% or more of the projected area or the number of all silver halide grains are occupied by substantially perfect cubic silver halide grains, which are silver bromochloroiodide or silver bromoiodide grains having a silver iodide content of 0.5 mol % or more and a silver chloride content of 3 mol % or less and are spectrally sensitized with sensitizing dyes.

6 Claims, 5 Drawing Sheets

$$S1 = Sa + Sb + Sc + Sd + S2$$

——————— OUTLINE OF (100) FACE THAT IS FACING UPWARD, PHOTOGRAPHED BY ELECTRON MICROSCOPE

- - - - - - - - QUADRANGLE FORMED BY EXTENDING FOUR EDGES OF (100) FACE

SILVER HALIDE PHOTOGRAPHIC LIGHT-SENSITIVE MATERIAL

BACKGROUND OF THE INVENTION

1. Field of the Invention

The present invention relates to a silver halide emulsion and a silver halide photographic light-sensitive material having a high sensitivity, an improved graininess, a high color density and hard photographic properties, resulting in excellent silver-saving properties.

2. Description of the Related Art

Emulsions having various outer shapes are known as silver halide emulsions constituting silver halide photographic light-sensitive materials. Examples are regular crystal emulsions containing, e.g., cubic, octahedral, tetradecahedral, and rhomboid dodecahedral grains, and twinned crystal emulsions containing double twinned crystals, such as tabular grains.

Among these emulsions, tabular grains constituting the twinned crystal emulsions have characteristics that light scattering is small owing to their outer shapes, a large amount of sensitizing dyes can be used because their specific surface areas are large, resulting in a high spectral sensitization efficiency. The characteristic features of the regular crystal emulsions, on the other hand, which are derived from their isotropic structures, are that formation of grains with, e.g., a multiple structure can be performed easily in accordance with the intended use, the emulsions can be monodispersed relatively easily, and spectral sensitization and chemical sensitization can be performed uniformly between grains. Therefore, the regular crystal emulsions are suitable for the purpose of providing hard-contrast emulsions with high color densities by increasing quantum sensitivities of the emulsions.

Representative examples of the regular crystal emulsions are a cubic emulsion whose surface is constituted by (100) faces and an octahedral emulsion whose surface is constituted by (111) faces. A variety of basic researches have long been made on these two types of emulsions. For example, as Tani describes in Photogr. Sci. Eng. 18:215–225 (1974), it is known that the intrinsic desensitization of the cubic emulsion with the (100) faces is smaller than that of the octahedral emulsion when sensitizing dyes are adsorbed. It is, therefore, considered that the cubic emulsion is superior to the octahedral emulsion as a spectral sensitizing emulsion.

It is known that the cubic emulsion can be easily formed with a silver halide primarily consisting of silver chloride. The manufacture of the cubic emulsion, however, is not necessarily easy with silver bromochloroiodide having a silver chloride content of 3 mol % or less, which is mainly used in high-sensitivity color photographic light-sensitive materials; the manufacture requires grain formation at a low pAg, that is difficult to control. If a silver halide solvent, such as ammonia, is used, the cubic emulsion can be formed even at a relatively high pAg. However, the presence of the solvent causes dissolution of the corners or the edges of grains to make it difficult to form a perfect cubic emulsion. On the other hand, when grain formation is performed at a low pAg or in the presence of ammonia, a reducing silver nucleus is formed in each silver halide grain. This sometimes results in undesirable photographic properties, such as production of fog. U.S. Pat. No. 3,655,394 discloses a method of manufacturing a cubic emulsion at a low pH and a relatively high pAg, under which conditions reducing silver nuclei are hard to form. In addition, JP-B-53-17492 ("JP-B" means Published Examined Japanese Patent Application), JP-B-57-56055, JP-B-60-35055, JP-A-62-115155 ("JP-A" means Published Unexamined Japanese Patent Application), JP-A-62-13250, and JP-A-2-87136 describe that a cubic emulsion can be manufactured at a high pAg or a sensitizing effect can be obtained when a specific compound is used together with the cubic emulsion. Although, however, a large number of examinations have been made on formation of cubic grains as described above, none of them completely solves the above problems.

In contrast, JP-A-62-229132 describes a cubic or tetradecahedral grain whose corners are rounded. When the present inventor performed supplementary tests, however, it was found that the sensitizing effect was obtained not by the rounded corners but by compounds which were added in order to round the corners.

Various studies have been made on the cubic emulsions as described above, but only few examples demonstrate the use of the emulsions as color photographic light-sensitive materials: the examples are some color negative films available from Eastman Kodak Co., Ltd., and motion-picture internegative films available from Eastman Kodak Co., Ltd. and Fuji Photo Film Co., Ltd.

According to the supplementary tests conducted on the patents described above by the present inventor, it was found that although nearly perfectly cubic grains could be made immediately after grain formation in some cases, those obtained through desalting and chemical sensitization, that were necessary in increasing the sensitivity, were all cubic grains whose corners were chipped. The present inventor has made further investigation but found no superiority of this imperfect cubic grain with chipped corners or edges to an octahedral emulsion and a tabular grain.

Moreover, silver halide color photographic light-sensitive materials have been recently required to have higher sensitivities and higher image qualities. In addition, for the purposes of saving resources, reducing cost, and decreasing quantities of replenishers of processing solutions, a strong demand has arisen for development of a silver halide color photographic light-sensitive material which can achieve a high color density even with a small silver amount without impairing image qualities, such as graininess.

SUMMARY OF THE INVENTION

It is an object of the present invention to develop a silver halide photographic light-sensitive material having a high sensitivity, a hard contrast, a high color density, and a good graininess and to thereby provide a silver halide photographic light-sensitive material having a high image quality and good silver saving properties.

The present inventor has made extensive studies considering that the cubic emulsion having the characteristic features as described above is suitable for the above object of the present invention and achieved the present invention by using substantially perfect cubes described below.

(1) A silver halide photographic light-sensitive material having at least one silver halide emulsion layer on a support, wherein the silver halide emulsion layer contains a silver halide emulsion in which 50% or more of the projected area or the number of all silver halide grains are occupied by substantially perfect cubic silver halide grains, which are silver bromochloroiodide or silver bromoiodide grains having a silver iodide content of 0.5 mol % or more and a silver chloride content of 3 mol % or less and are spectrally sensitized with sensitizing dyes.

(2) The silver halide light-sensitive material described in item (1) above, wherein the silver iodide content of the silver halide emulsion is 1.5 mol % or more.

(3) The silver halide light-sensitive material described in item (1) above, wherein the silver halide emulsion does not substantially contain silver chloride.

(4) The silver halide light-sensitive material described in item (1) above, wherein sensitizing dyes are added to the silver halide emulsion before start of chemical sensitization.

(5) The silver halide light-sensitive material described in item (1) above, wherein 20% or more of a silver amount of the silver halide emulsion are grown in the presence of a compound represented by Formula (1) below:

$$\text{-}(A)_x\text{-}(B)_y\text{-} \qquad \text{Formula (1)}$$

A represents a repeating unit derived from an ethylenic unsaturated monomer having at least one basic nitrogen atom, B represents a repeating unit derived from a monomer other than A, and x and y each represent a percentage by weight of each individual component, x representing 0.1 to 100, and y representing 0 to 99.9.

DETAILED DESCRIPTION OF THE INVENTION

The present invention will be described in detail below.

A silver halide emulsion according to the present invention is a substantially perfect cubic emulsion that consists of silver bromochloroiodide on silver bromoiodide having a silver iodide content of 0.5 mol % or more and a silver chloride content of 3 mol % or less and is spectrally sensitized with sensitizing dyes.

This "substantially perfect cube" is a cube whose corners or edges are almost not chipped. This means that (100) faces constituting a cube are unlimitedly close to squares or rectangles. This substantially perfect cube is defined as follows.

Figure 1:
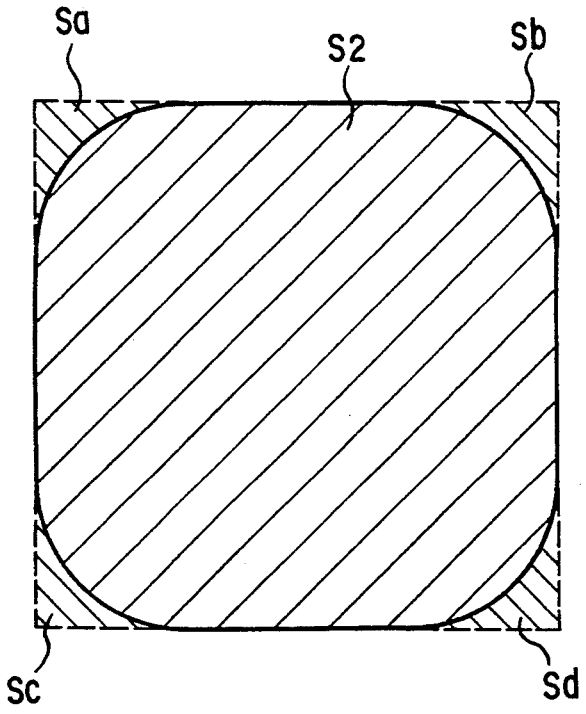
FIG. 1 is a view for explaining a cubic grain according to the present invention.

Shadowing is performed for a (100) face of a cubic emulsion at an angle of 45° by using carbon, forming a sample by a regular replica process. The sample is photographed in a direction perpendicular to the (100) face by using an electron microscope. Subsequently, the edges of the (100) face that is facing upward are extended to form a quadrangle that is geometrically surrounded by four straight lines, and the area of the quadrangle is calculated as S1. Thereafter, the surrounding of the (100) face, that is not shadowed and exits on perfectly the same plane as the (100) face, is drawn, and its area is calculated as S2 (if intraface epitaxy is present, the area of the (100) face is calculated assuming that the epitaxy is not present). If S1=S2, the cube is a geometrically perfect cube. The cube of the present invention has S2/S1 of 0.96 or more and is in this way defined as a substantially perfect cube. This S2/S1 will be referred to as a perfection ratio hereinafter. The perfection ratio is preferably as large as possible, and a cube having that of 0.99 or more is more preferable. FIG. 1 schematically shows the method of obtaining S1 and S2.

Silver halide emulsion grains constituting a high-sensitivity color photographic light-sensitive material as the object of the present invention must contain 0.5 mol % or more of silver iodide in order to increase the sensitivity and enhance adsorption of sensitizing dyes to impart stability with time to the material. In the silver halide emulsion according to the present invention, the silver iodide content can be any given value as long as it is 0.5 mol % or more. However, to provide an emulsion with a hard contrast and a high color density, the range of the silver iodide content is preferably 0.5 to 20 mol %, and more preferably 1.5 to 5 mol %. In the case of a silver halide containing silver iodide, formation of the substantially perfect cube described above becomes more difficult than in the cases of silver chloride, silver chlorobromide, and pure silver bromide. The present invention makes it possible to form a substantially perfect cube containing silver iodide, which has been considered difficult to form, and thereby takes advantage of not only the characteristics of the substantially perfect cube, i.e., a high sensitivity and a hard contrast but the characteristics of silver iodide, i.e., the functions of enhancing adsorption of sensitizing dyes and controlling chemical sensitization.

In a silver halide of the present invention, a silver chloride content can be any arbitrary value as long as it is 3 mol % or less, and pure silver bromoiodide not containing silver chloride at all can also be used. If the silver chloride content exceeds 3 mol %, formation of the perfect cubes defined in the present invention becomes relatively easier in the step of grain formation, but deformation of grains undesirably easily occurs in the step of chemical sensitization for achieving a high sensitivity or while the grains are in the form of a solution before coating. In addition, adsorption of sensitizing dyes is weakened, and this makes it difficult to maintain the performance of coated films with time in a high-humidity condition. JP-A-55-124139 discloses that a perfect cube can be formed by selectively growing silver chloride in a silver amount of 10% at the corners of a silver bromoiodide cube whose corners are slightly chipped. As will be described in the examples of the present invention, however, such an inhomogeneous grain is extremely poor in stability and therefore cannot keep its shape after the chemical sensitization step for obtaining a high sensitivity. Also, a grain of this type has no superiority in photographic properties. In the present invention, therefore, it is most preferable that substantially no silver chloride be contained.

"Substantially no silver chloride is contained" means that the addition amount of chloride ions in formulation in the process of manufacturing a silver halide emulsion is 1 mol % or less with respect to the addition amount of silver nitrate or that the silver chloride content of a silver halide grain is 0.1 mol % or less.

Figure 2:
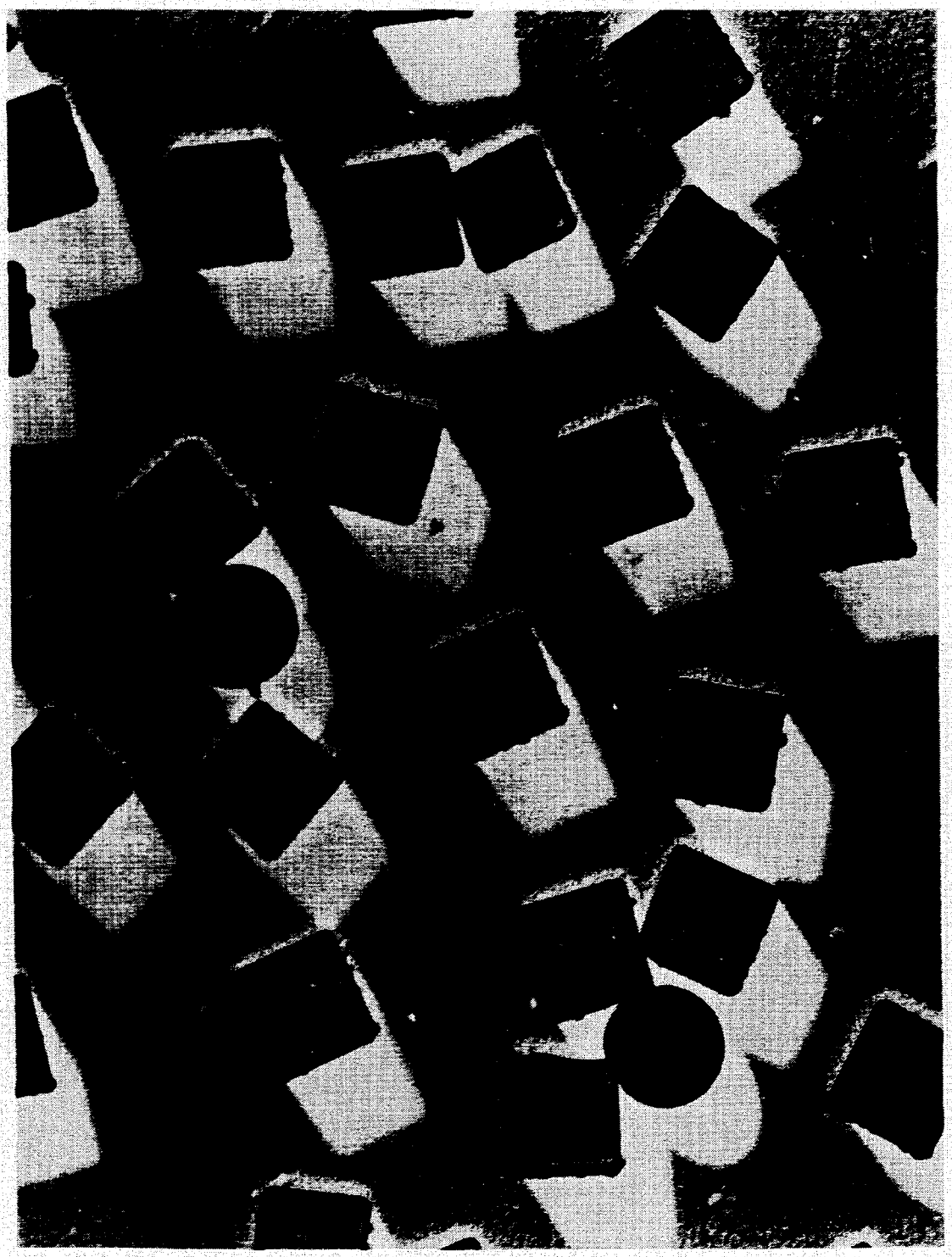
FIG. 2 is an electron micrograph showing the crystal structure of a substantially perfect cubic silver halide grain according to the present invention.
Figure 3:
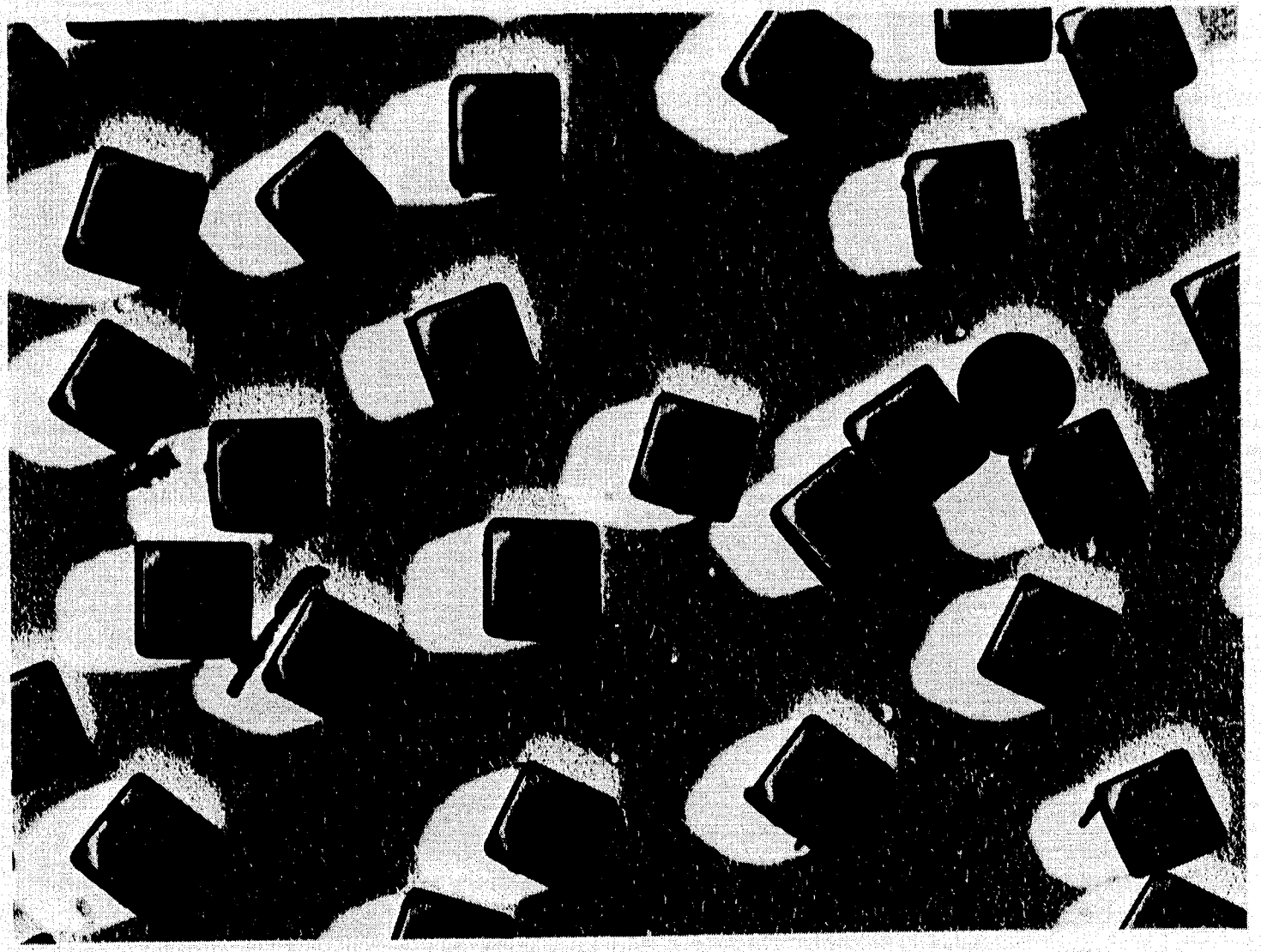
FIG. 3 is an electron micrograph showing a silver halide grain in which (111) faces exposed at the corners of a cube.
Figure 4:
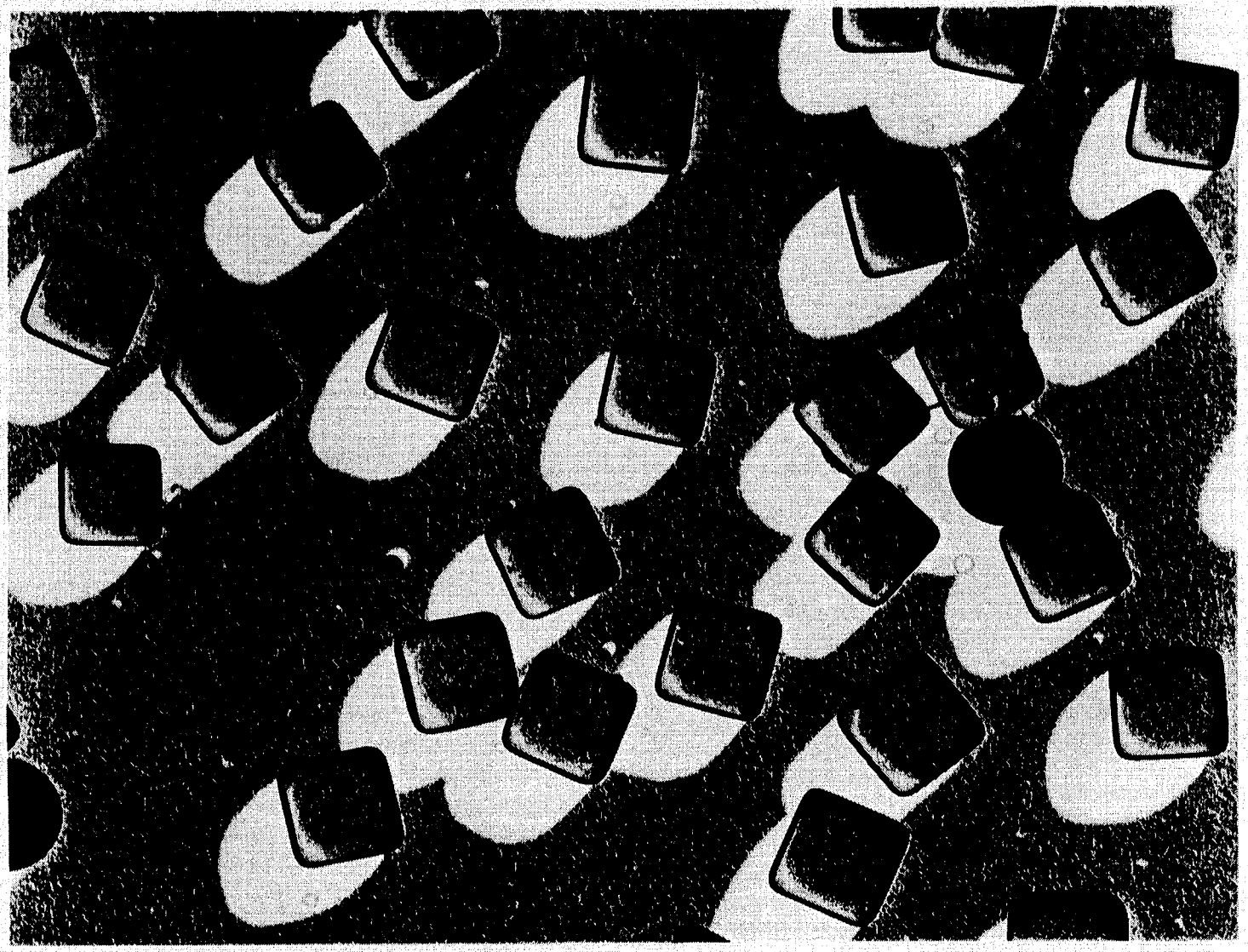
FIG. 4 is an electron micrograph showing a silver halide grain in which the corners of a cube are rounded.

Imperfect cubes inapplicable to the present invention are cubes with perfection ratios of less than 0.96. These cubes are roughly divided into two types: one is a cube in which (111) faces remain at the corners of the cube because the growth rate of the (111) faces is not high enough compared to that of (100) faces owing to, e.g., a high pAg; the other is a cube whose corners are rounded under the influence of physical ripening during the emulsion manufacturing process. In either case, the cube is low in sensitivity and soft in gradation compared to the substantially perfect cube of the present invention, and its maximum color density also decreases. Conversely speaking, the potential of a cube cannot be brought out unless the substantially perfect cube of the present invention is used, and this makes it possible to provide a silver halide emulsion having a very high performance, i.e., having a high sensitivity, a hard gradation, and a high color density compared to those of conventional cubes. The reasons why such a perfect cube cannot be formed by conventional techniques are, for example, that it is originally difficult to form a cube with a silver halide containing silver iodide, and that even if a cube is formed in the step of grain formation, the cube is readily influenced by physical ripening in the subsequent desalting step or chemical sensitization step, as will be described later, and this rounds the corners of the cube to cause the cube to lose its perfection. As an example, FIG. 2 shows the substantially perfect cube of the present invention, FIG. 3 shows a cube in which (111) faces are exposed at the corners of the cube, and FIG. 4 shows a cube whose corners are rounded under the influence of physical ripening. Each emulsion has an equivalent-sphere diameter of 0.5 μm and is subjected to desalting and chemical sensitization. Each of the emulsions shown in FIGS. 2, 3, and 4 is a silver bromoiodide cubic emulsion having a silver iodide content of 2 mol %.

It is preferable to use a silver halide emulsion in which 80% or more, and most preferably 90% or more the projected area on the number of all silver halide grains are accounted for by silver halide grains as the substantially perfect cubes of the present invention.

Although the substantially perfect cubic emulsion of the present invention can be manufactured by any method, representative manufacturing methods will be described below.

A silver halide grain as a nucleus of the silver halide emulsion of the present invention can be formed by any conventional method as long as the grain is a regular crystal. A preferable method is to add an aqueous silver nitrate solution and an aqueous water-soluble halide salt solution to an aqueous gelatin solution by double-jet. A controlled double-jet method which controls a pAg is more preferable. The history of a pAg may be such that it is high in the initial stages of nucleation and gradually decreased with addition or vice versa. The pAg can also be maintained constant from the start to the end of nucleation.

As the shape of a silver halide emulsion serving as a nucleus, a tetradecahedron is more preferable than an octahedron, and a cube is more preferable than a tetradecahedron. A cube is most preferably the one that meets the definition of the substantially perfect cube of the present invention.

As the silver halide grains as nuclei, it is preferable to use a large amount of a silver halide emulsion prepared beforehand as seed crystals.

It is known that the crystal habit of a regular crystal depends on the pAg during growth; generally, in a system not using a solvent such as ammonia, cubes, tetradecahedrons, and octahedrons are formed at a pAg of 7 or less, 7 to 8, and 8 or more, respectively. Manufacturing a silver halide without using any solvent such as ammonia prevents production of unnecessary silver nuclei during grain formation and is therefore preferable to provide a silver halide photographic light-sensitive material having a low fog and a high storage stability.

The mechanism by which the crystal habit changes in accordance with a pAg has not been completely uncovered yet. However, as described in James et al., "The Theory of Photographic Process," it is generally agreed that the condition of adsorption of bromide ions to faces changes in accordance with the bromide ion concentration, and this produces a difference in growth rate between (111) and (100) faces to cause the crystal habit to change.

Figure 5:
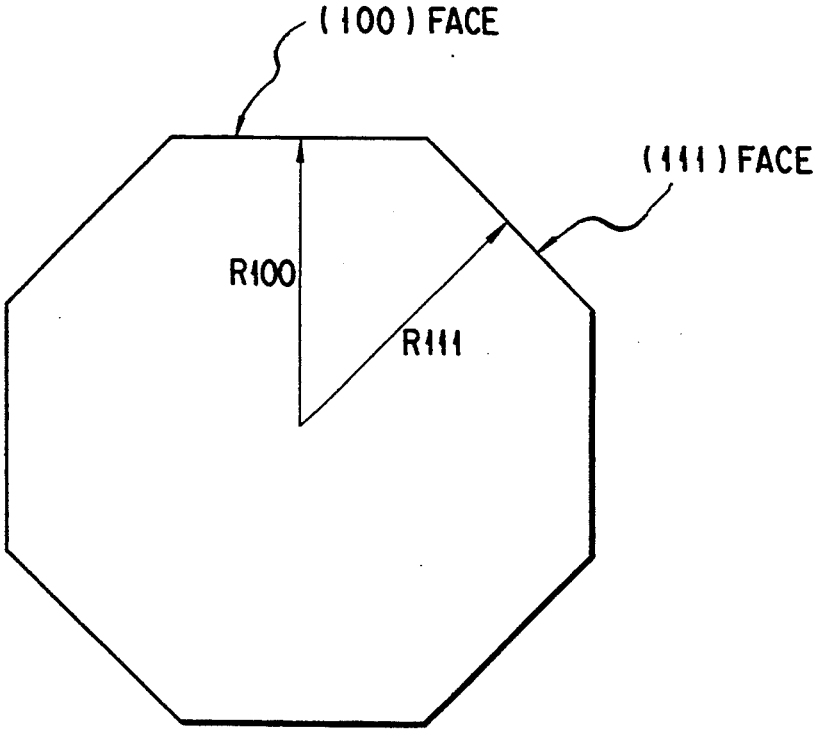
FIG. 5 is a view for explaining the growth rates of a (111) face and a (100) face of a tetradecahedral grain.

Assume that, as shown in FIG. 5, a distance from the center to a (100) face of a tetradecahedral grain is R100, and a distance from the center to a (111) face of the grain is R111.

As can be readily understood from FIG. 5, R111, R100, and a ratio (dR111/dt)/(dR100/dt) of the growth rates of the two faces before growth is started determine the crystal habit of the final grain. In order for the grain to become a perfect cube, it is necessary that the (111) faces grow faster than the (100) faces and the (100) faces finally disappear. Geometrically, $(dR111/dt/(dR100/dt) > 3^{\frac{1}{3}}$ $(=1.73)$. In J. Colloid. Interface Sci. 93, 461 (1983), Sugimoto obtained the pBr dependencies of the critical growth rates of the (100) face and the (111) face. According to this literature, a relation of $(dR111/dt)/(dR100/dt) > 3^{\frac{1}{3}}$ $(=1.73)$ is satisfied for $pAg < 6.5$. That is, to manufacture the substantially perfect cubes of the present invention, growth must be performed at a pAg of 6.5 or less when a solvent such as ammonia is not used.

When a silver halide emulsion is to be manufactured in a low-pAg environment at a pAg of 8 or less, a controlled double-jet method is normally used, which performs addition of silver nitrate and an aqueous halide salt solution at the same time while controlling the pAg. As a method to control a pAg to a target value by controlling the addition amount of an aqueous halide salt solution or silver nitrate, a PID control method disclosed in, e.g., JP-A-61-65302 is common. When control is performed at a pAg close to an equivalence point of 6.5 or less in order to manufacture the substantially perfect cubes of the present invention, an excess halogen concentration present in a reaction solution decreases to cause the pAg to vary largely even with a slight change in flow rate, making it difficult to control the pAg to a target value. In that case, control can be safely performed by, e.g., improving the condition of stirring, decreasing the addition rate of silver nitrate, decreasing the concentration of an aqueous halogen solution, and optimizing the PID parameters. Alternatively, control can be performed on the silver excess side by selecting a pAg lower than the equivalence point.

It is generally known that cubes can be formed at a relatively high pAg when a solvent such as ammonia is used. The present inventor has confirmed that a pAg satisfying the condition of (dR111/dt)/(dR100/dt)>$3^{\frac{1}{2}}$ (=1.73) can be raised up to 7.5 in the presence of 0.2 mol/l of ammonia. However, when a silver halide is grown in the presence of a silver halide solvent, a process of physical ripening (to be described later) becomes liable to occur, and so a means for preventing physical ripening must be selected with enough care.

Several compounds, other than a silver halide solvent, that can increase the pAg capable of forming cubes are also known. A sensitizing dye that is adsorbed preferentially to (100) faces makes it feasible formation of cubes at a high pAg. In addition, F. H. Claus et al. describe in Phot. Sci. Eng., 12(4), page 207 (1968) that association of a solvent (water) has a large influence on a crystal habit, demonstrating that diluting with water, decreasing an electrolyte concentration, and adding urea, for example, are the methods of forming cubes at a high pAg.

The present inventor has found that a polymer containing a repeating unit having at least one basic nitrogen atom is useful in formation of cubes at a high pAg. This compound will be described below.

A polymer containing a repeating unit having at least one basic nitrogen atom according to the present invention will be described below.

The polymer of the present invention contains a repeating unit having at least one basic nitrogen atom and is preferably soluble in neutral water, an acidic aqueous solution, or an alkaline aqueous solution. "Preferable solubility" means that the polymer is soluble in an amount of 0.1 wt % or more, more preferably 1 wt % or more, and most preferably 10 wt % or more in a medium.

A preferable example of the polymer of the present invention is the polymer represented by Formula (1) mentioned earlier.

In Formula (1), A represents a repeating unit derived from an ethylenic unsaturated monomer having at least one basic nitrogen atom, B represents a repeating unit, other than A, derived from an ethylenic unsaturated monomer, and each of x and y represents a percentage by weight. x represents 0.1 to 100, and y represents 0 to 99.9.

The details of Formula (1) will be described below.

The basic nitrogen atom contained in the repeating unit represented by A may be any of primary, secondary, and tertiary amino groups and may take the structure of ammonium salt neutralized with acid. The nitrogen atom may also take the form of a heterocyclic group having a basic nitrogen atom in its ring.

Examples of substituents for the secondary and tertiary amino groups are a substituted or nonsubstituted alkyl group (e.g., methyl, ethyl, n-propyl, n-butyl, n-octyl, benzyl, phenethyl, 2-methoxyethyl, 2-ethoxyethyl, 2-hydroxyethyl, and 2-hydroxypropyl) that has 1 to 20 carbon atoms, and a substituted or non-substituted aryl group (e.g., phenyl, naphthyl, 2-methylphenyl, 3-methylphenyl, 4-methoxyphenyl, 4-hydroxyphenyl, and 4-chlorophenyl) that has 6 to 20 carbon atoms.

Examples of the heterocyclic group containing the basic nitrogen atom in its ring are a substitutable, saturated or unsaturated heterocyclic ring (e.g., aziridine, pyrrolidine, piperidine, pyrrole, pyridine, indole, and quinoline) that contains only one nitrogen atom as a hetero atom, and a substitutable, saturated or unsaturated heterocyclic ring (e.g., imidazoline, imidazole, pyrazole, oxazole, thiazole, piperazine, triazole, tetrazole, oxadiazole, oxatriazole, dioxazole, pyrimidine, pyrimidazole, pyrazine, triazine, tetrazine, and benzimidazole) that has two or more hetero atoms selected from, e.g., a nitrogen atom, an oxygen atom, and a sulfur atom and contains at least one nitrogen atom.

Examples of a monomer of the repeating unit represented by A in a polymer of Formula (1) of the present invention will be described below, but the present invention is not limited to these examples.

One example is a monomer having a heterocyclic group containing the basic nitrogen atom, such as vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl-)aminopyridine, N-vinylbenzylimidazole, N-methacryloyloxyethylpyrrolidine, N-acryloylpiperazine, 1-vinyltriazole, 3,5-dimethyl-1-vinylpyrazole, N-methacryloyloxyethylmorpholine, N-vinylbenzylpiperidine, and N-vinylbenzylmorpholine.

Another example is a noncyclic monomer, such as
N,N-dimethylaminoethylmethacrylate,
N,N-diethylaminoethylmethacrylate,
N,N-diethylaminoethylacrylate,
N,N-dimethylaminopropylacrylamide,
N,N-diethylaminoethylacrylamide,
N,N-dimethylaminomethylstyrene,
N,N-diethylaminomethylstyrene,
N,N-dibutylaminomethylstyrene,
N-methyl-N-vinylbenzylamine, N-vinylbenzylamine,
2-(2-methacryloyloxy)ethoxyaniline,
N-ethyl-N-vinylbenzylamine,
N-methyl-N-benzylaminoethylmethacrylate, and
(1-methyl-2-acrylamido)ethylamine.

Of these monomers, the monomer having a heterocyclic group containing the basic nitrogen atom in its ring is most preferable.

These monomers can be used either singly or in the form of a copolymer of two or more types of them in a polymer.

A preferable example of a copolymerizable ethylenic unsaturated monomer from which the repeating unit represented by B is derived is the one whose homopolymer is soluble in neutral water, an acidic aqueous solution, or an alkaline aqueous solution. Practical examples are a nonionic monomer, such as acrylamide, methacrylamide, N-methylacrylamide, N,N-dimethylacrylamide, N-acryloylmorpholine, N-ethylacrylamide, diacetoneacrylamide, N-vinylpyrrolidone, and N-vinylacetamide; a monomer having an anionic group, such as acrylic acid, methacrylic acid, itaconic acid, vinylbenzoic acid, styrenesulfonic acid, styrenesulfinic acid, phosphonoxyethylacrylate, phosphonoxyethylmethacrylate, 2-acrylamido-2-methylpropanesulfonic acid, 3-acrylamidopropionic acid, and 11-acrylamidoundecanoic acid, and its salt (e.g., sodium salt, potassium salt, and ammonium salt); and a monomer having a cationic group, such as N,N,N-trimethyl-N-vinylbenzylammoniumchloride and N,N,N-trimethyl-N-3-acrylamidopropylammoniumchloride.

The repeating unit of this type can contain a copolymer component that is rendered water-soluble by, e.g., hydrolysis. Examples are a repeating unit of vinyl alcohol (obtained by hydrolysis of a vinyl acetate unit) and a repeating unit of maleic acid (obtained by ring opening of anhydrous maleic acid).

Of these copolymer components, the repeating unit derived from a nonionic monomer or an anionic monomer is most preferable.

These ethylenic unsaturated monomers can be used either singly or in the form of a copolymer of two or more types of them if necessary.

The polymer of the present invention can also be copolymerized with another hydrophobic ethylenic unsaturated monomer so long as the water solubility of the polymer is impaired. Examples of such a monomer are ethylene, propylene, 1-butene, isobutene, styrene, α-methylstyrene, methylvinylketone, a monoethylenic unsaturated ester of aliphatic acid (e.g., vinyl acetate and allyl acetate), an ester of an ethylenic unsaturated monocarboxylic acid or dicarboxylic acid (e.g., methylmethacrylate, ethylmethacrylate, n-butylmethacrylate, n-hexylmethacrylate, 2-ethylhexylmethacrylate, cyclohexylmethacrylate, benzylmethacrylate, methylacrylate, ethylacrylate, n-butylacrylate, 2-hydroxyethylmethacrylate, 2-methoxyethylmethacrylate, 2-methanesulfonamidoethylmethacrylate, and monomethyl maleate), an ethylenic unsaturated amide of monocarboxylic acid (e.g., t-butylacrylamide, t-octylacrylamide, and 3-methoxypropylmethacrylamide), a monoethylenic unsaturated compound (e.g., acrylonitrile and methacrylonitrile), dienes (e.g., butadiene and isoprene).

x and y each represent the percentage by weight of each copolymer component. Although x and y change in accordance with, e.g., the structure of a monomer and the intended use, x is 0.1 to 100, preferably 1 to 50, and most preferably 1 to 30, and y is 0 to 99.9, preferably 50 to 99, and most preferably 70 to 99. x and y satisfy the relation that $x+y=100$.

The polymer of the present invention can be manufactured by various polymerization methods, such as solution polymerization, precipitation polymerization, suspension polymerization, bulk polymerization, and emulsion polymerization. In addition, a method of starting the polymerization can be any of, e.g., a method of using a free-radical initiator, a method of radiating light or rays, and a thermal polymerization method. These polymerization methods and methods of starting polymerization are described in, e.g., Sadaji Tsuruta, "High Polymer Synthesis Reaction," a revised edition (Nikkan Kogyo Shinbunsha, 1971); and Takayuki Otsu and Masanobu Kinoshita, "Method of High Polymer Synthesis Experiment," Kagaku Dojin, 1972, pages 124 to 154.

Among the above polymerization methods, the solution polymerization method using a free-radical initiator is most preferable. Examples of a solvent for use in the solution polymerization are water and a variety of organic solvents, such as ethyl acetate, methanol, ethanol, 1-propanol, 2-propanol, acetone, dioxane, N,N-dimethylformamide, N,N-dimethylacetamide, toluene, n-hexane, and acetonitrile. These organic solvents can be used either singly or in the form of a mixture of two or more types of them. These organic solvents can also be used in the form of a solvent mixture with water. Of these solvents, water or a mixture of water and an organic solvent miscible with water is most preferable for the polymer of the present invention.

The polymerization temperature must be set in accordance with the molecular weight of a polymer to be produced or the type of an initiator. Although a temperature of 0° C. or less to 100° C. or more is possible, polymerization is commonly performed at a temperature of 30° C. to 100° C.

Examples of the free-radical initiator for use in polymerization are an azo-based initiator, such as 2,2'-azobisisobutyronitrile, 2,2'-azobis(2,4-dimethylvaleronitrile), 2,2'-azobis(2-amidinopropane)dihydrochloride, and 4,4'-azobis(4-cyanopentanoicacid), and a peroxide-based initiator, such as benzoylperoxide, t-butylhydroperoxide, and potassium persulfate (also usable as a redox initiator in combination with, e.g., sodium hydrosulfite).

Although an amount of the initiator can be controlled in accordance with the polymerizability of each monomer or the molecular weight of a polymer required, it is preferably 0.01 to 10 mole %, and most preferably 0.01 to 2.0 mole % with respect to the monomer.

To synthesize the polymer of the present invention in the form of a copolymer, polymerization may be performed by placing the total amount of monomers to be used in a reactor vessel beforehand and then supplying an initiator. However, it is more preferable to perform synthesis through a process of dropping monomers into a polymerization medium.

In this case, two or more types of ethylenic unsaturated monomers to be used may be dropped either in the form of a mixture or independently of each other. In this dropping, the ethylenic unsaturated monomers may be dissolved in an appropriate co-solvent. Examples of the co-solvent are water, an organic solvent (such as those described above), and a solvent mixture of water and the organic solvent.

Although the dropping time depends on, e.g., the polymerization reaction activity of each ethylenic unsaturated monomer or the polymerization temperature, it is preferably 5 minutes to 8 hours, and most preferably 30 minutes to 4 hours. The dropping rate can be either equal throughout the dropping or varied properly within the dropping time. When ethylenic unsaturated monomers are to be dropped independently of each other, the total dropping time or the dropping rate of each monomer can be freely changed as needed. In particular, if the difference in polymerization reactivity between the ethylenic unsaturated monomers is large, it is preferable that, for example, a monomer having a higher reactivity be dropped more slowly.

The polymerization initiator can be added to a polymerization solvent in advance or can be added simultaneously with the addition of ethylenic unsaturated monomers. The polymerization initiator can also be dissolved in a solvent and dropped in the form of a solution independently of ethylenic unsaturated monomers. Alternatively, two or more types of these addition methods can be combined.

The polymer of the present invention can be synthesized by the above polymerization reaction by using the ethylenic unsaturated monomer having the basic nitrogen atom from which the repeating unit represented by A is derived and another ethylenic unsaturated monomer from which the repeating unit represented by B is derived. The polymer can also be synthesized by reacting a compound having the basic nitrogen atom with a polymer having a functional group (e.g., —OH, —COOH, —$NH_2$, —NHR, —SH, and an active halogen).

Examples of the compound that has the basic nitrogen atom and can be effectively bonded to the polymer chain are those having functional groups, such as —OH, —COOH, —$NH_2$, and —NHR. Practical examples are piperidine, morpholine, imidazole, 1,2,4-triazole, pyrazole, N-hydroxymorpholine, N-hydroxyethylpiperidine, 4-aminopyridine, 2-hydroxyethylimidazole, N-(3-aminopropyl)imidazole, 4-aminomethylpyrrolidine, N-hydroxyethylpyrrolidine, 2-hydroxybenzimidazole, dimethylamine, diethylamine, dibutylamine, ethylamine, n-butylamine, N-(2-aminoethyl)piperazine, N-(2-aminoethyl)-N,N-dimethylamine, N-(3-aminopropyl)-N,N-dimethylamine, N-(2-aminoethyl)-N,N-dibutylamine, N-(2-aminopropyl)-N,N-diethylamine, 4-dimethylaminophenol, and 3-dimethylaminobutanoicacid.

In the present invention, compounds that can be most effectively Joined to a polymer chain are imidazoles.

These polymer and basic nitrogen atom-containing compound can be reacted directly or combined via, e.g., diisocyanate, diol, dicarboxylic acid, or diepoxide.

Practical examples of polymers containing a repeating unit having the basic nitrogen atom represented by Formula (1) of the present invention will be presented below, but the present invention is not limited to these examples. The numbers given in parentheses represent the percentage by weight ratio between individual copolymer components.

| | |
|---|---|
| P-1 | Acrylamide/soda acrylate/vinylimidazole/diacetone acrylamide copolymer (50/5/3/42) |
| P-2 | Acrylamide/soda acrylate/vinylimidazole/diacetone acrylamide copolymer (42/7/8/43) |
| P-3 | Acrylamide/soda acrylate/vinylimidazole/diacetone acrylamide copolymer (37/5/15/43) |
| P-4 | Acrylamide/acrylic acid/vinylimidazole hydrochloride/diacetone acrylamide copolymer (22/5/30/43) |
| P-5 | Acrylamide/soda acrylate/vinylimidazole copolymer (90/7/3) |
| P-6 | Acrylamide/soda acrylate/vinylimidazole copolymer (83/7/10) |
| P-7 | Acrylamide/vinylimidazole copolymer (90/10) |
| P-8 | Methacrylamide/vinylimidazole copolymer (90/10) |
| P-9 | N,N-dimethylacrylamide/vinylimidazole copolymer (92/8) |
| P-10 | Acrylamide/soda styrenesulfonate/vinylimidazole copolymer (80/10/10) |
| P-11 | Methylmethacrylate/soda 2-acrylamido-2-methylpropanesulfonate/vinylimidazole copolymer (15/75/10) |
| P-12 | Styrene/acrylamide/soda 2-acrylamido-2-methylpropanesulfonate/vinylimidazole copolymer (10/40/40/10) |
| P-13 | Acrylamide/soda methacrylate/2-methyl-1-vinylimidazole/diacetoneacrylamide copolymer (45/5/10/40) |
| P-14 | Acrylamide/2-methyl-1-vinylimidazole copolymer (85/15) |
| P-15 | Acrylamide/soda acrylate/2-vinylpyridine copolymer (80/5/15) |
| P-16 | Acrylamide/soda acrylate/diacetoneacrylamide/2-methyl-1-vinylimidazole copolymer (38/22/30/10) |
| P-17 | Acrylamide/4-vinylpyridine copolymer (90/10) |
| P-18 | Acrylamide/diacetoneacrylamide/4-vinylpyridine copolymer (50/40/10) |
| P-19 | Acrylamide/soda acrylate/diacetoneacrylamide/4-vinylpyridine copolymer (50/9/34/7) |
| P-20 | Acrylamide/1-acryloyloxyethylimidazole copolymer (80/20) |
| P-21 | Acrylamide/N-vinylpyrrolidone/1-acryloyloxyethyl imidazole copolymer (85/5/10) |
| P-22 | Acrylamide/diacetoneacrylamide/N-vinylbenzyl imidazole copolymer (50/40/10) |
| P-23 | Soda 2-acrylamido-2-methylpropanesulfonate/3-thiapentylacrylate/vinylimidazole copolymer (87/3/10) |
| P-24 | Acrylamide/vinylimidazole/N-vinylbenzylpiperidine copolymer (90/5/5) |
| P-25 | Methylacrylate/acrylamide/soda acrylate/vinyl imidazole/1-acryloyloxyethyltriazole copolymer (15/57/15/10/3) |
| P-26 | Acrylamide/soda acrylate/N,N-dimethylaminoethyl methacrylate/diacetoneacrylamide copolymer (30/5/50/15) |
| P-27 | Acrylamide/soda acrylate/vinylimidazole/dimethyl aminomethylstyrene copolymer (75/12/8/5) |
| P-28 | Acrylamide/N-(2-amino-2-methylpropyl)methacryl amide copolymer (90/10) |
| P-29 | N,N-dimethylaminopropylacrylamide/potassium acrylate/diacetoneacrylamide copolymer (25/15/60) |
| P-30 | |

-continued

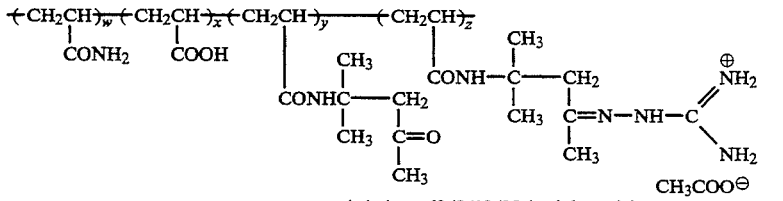

w/x/y/z = 60/5/10/25 (weight ratio)

P-31

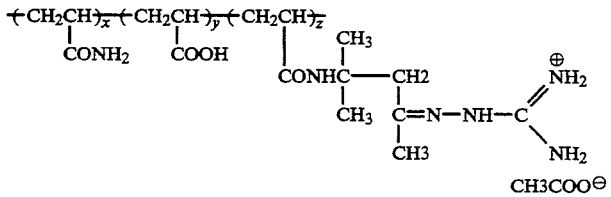

x/y/z = 15/15/70 (weight ratio)

P-32

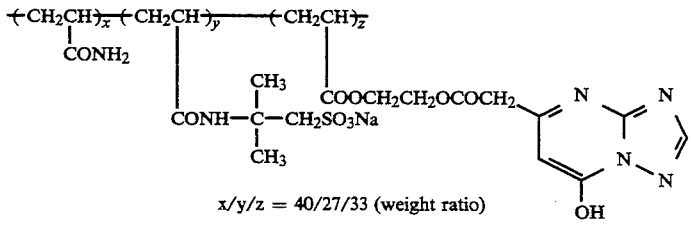

x/y/z = 40/27/33 (weight ratio)

Synthesis examples of the polymer of the present invention will be described below.

Synthesis example (synthesis of polymer P-2)

910 g of distilled water were placed in a 2-l three neck distillation flask, to which a stirrer, a reflux condenser, and a thermometer were attached, and stirred at a temperature of 70° C. under a nitrogen flow. Immediately after a solution prepared by dissolving 0.45 g of potassium persulfate into 65 g of distilled water was added to the water, a solution mixture of 140.6 g of acrylamide, 28.5 g of vinylimidazole, 16.6 g of acrylic acid, 139.5 g of diacetoneacrylamide, 55.9 g of isopropylalcohol, 250.5 g of distilled water, and 9.46 g of sodium hydroxide was dropped into the resultant solution at a constant rate over one hour. After the resultant solution mixture was stirred at 70° C. for one hour after the dropping, the internal temperature was raised to 90° C., and the solution was further stirred at that temperature for four hours.

The resultant solution was cooled and added with 1 l of methanol to prepare a polymer solution. The resultant polymer solution was poured into acetone, and precipitation and decantation were repeatedly performed. The resultant precipitate was filtered out and dried to obtain 325.8 g of the polymer P-2 of interest (yield 98%).

It is possible to arbitrarily use two or more types of the polymers of the present invention described above.

A preferable range of the molecular weight or the degree of polymerization of the polymer of the present invention changes in accordance with, e.g., the type or properties of an emulsion to which the polymer is applied and the structure of the polymer. The range is, however, preferably 5,000 to 1,000,000, and most preferably 10,000 to 500,000.

A compound represented by Formula (1) of the present invention can be added at any step during grain formation as long as the substantially perfect cubes of the present invention can be obtained. It is preferable that 20% or more, and more preferably 50% or more of a silver amount be added in the presence of a compound represented by Formula (1). The present inventor has made researches and confirmed that the substantially perfect cubes of the present invention could be prepared even at pAg=7.8 when addition of 90% of a silver amount was performed in the presence of a compound represented by Formula (1), whereas it was necessary to control the pAg to 6.3 in order to obtain the cubes of the present invention without the addition. Note, however, that when grain formation is performed in the presence of a compound represented by Formula (1), a care must be taken to prevent reproduction of nuclei because this decreases the critical growth rate.

A necessary use amount of a compound represented by Formula (1) depends on the type of a compound and the pAg to be controlled, so the amount must be obtained experimentally. Generally, a use amount of 0.1 to 10 g per mol of a silver halide is preferable.

A compound represented by Formula (1) of the present invention has a high ability as a protective colloid as well as the ability to form cubes at a high pAg and is therefore useful in preventing aggregation while a cubic emulsion is left to stand in the form of a solution. When a compound represented by Formula (1) is to be used for this purpose, the compound can be added at any timing during the emulsion manufacturing process; that is, any of grain formation, desalting, washing, redispersion, chemical sensitization, and preparation of coating emulsions can be selected. The compound is preferably added after grain formation and before the end of chemical sensitization. When the compound is to be used for this purpose, the content of the compound is preferably 0.01 to 5 g, and more preferably 0.1 to 3 g per mol of a silver halide.

A compound represented by Formula (1) of the present invention can be added directly in the form of a powder or dissolved in water, an acidic aqueous solution, or an alkaline aqueous solution and added in the form of a solution.

Method for formation of cubes at a high pAg without using a silver halide solvent, such as the method using, e.g., a compound represented by Formula (1), urea, or sensitizing dyes as described above is preferable in preventing an increase in the process of physical ripening to be described later. In addition, control of a high pAg is relatively easy even in a large scale and is therefore a very favorable method in terms of suitability for manufacture.

It is preferable to use an oxidizer for silver during the manufacture of emulsions of the present invention. The use of the oxidizer is more preferable especially when a silver halide solvent such as ammonia is used.

The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced may form a silver salt hard to dissolve in water, such as a silver halide, silver sulfide, or silver selenide, or a silver salt easy to dissolve in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O)$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element and thiosulfonate, and an organic oxidizers such as quinones.

An ion located at the corner of a cube can be removed simply by cutting only three bonds adjacent to that corner. An ion at the edge is held by four bonds, and that in a (100) face is held by five bonds. This means that the corners of a cube are in a very unstable state; they are readily susceptible to physical ripening and easily chipped or rounded. To form the substantially perfect cubes of the present invention, a care must be taken to eliminate physical ripening in each and every step from grain formation to coating of emulsions on a support.

In the step of performing growth with the pAg kept constant after nucleation, it is preferable to perform the growth at a rate close to the critical growth rate so as to eliminate physical ripening. More specifically, to allow the addition rate of an aqueous silver nitrate solution to be proportional to the surface area of grains in a reaction solution, the addition rate of silver nitrate is gradually increased as a linear or quadratic function of time. The critical growth rate can be obtained by performing growth while changing the addition rate immediately after the start of growth and by checking whether nucleation occurs again during the growth. The addition rate is preferably 70% or more, and more preferably 85% or more of the critical growth rate.

Although the temperature during growth of a silver halide normally ranges from 35° C. to 90° C., selecting lower temperatures is preferable in eliminating physical ripening. Note that since the critical growth rate also decreases when the temperature decreases, a time required to finish the growth of silver halide grains is prolonged relative to the rate, and this sometimes increases the probability that the grains are influenced by physical ripening. An optimal temperature for manufacturing the substantially perfect cubes of the present invention exists, but the temperature depends on various factors, such as the type and concentration of gelatin, the grain size, the type and amount of a solvent, and the presence/absence of additives. Therefore, the optimal temperature must be so selected as to meet these conditions.

A method of adding a silver halide adsorbent is also a preferable method to eliminate the influence of physical ripening. For this purpose, any adsorbent that is adsorptive to a silver halide can be used provided that the adsorbent is strongly adsorptive has no adverse effect on photographic properties. To form the substantially perfect cubes of the present invention, a compound having a mercapto group and/or a sensitizing dye is favorable. These absorbents can be added at any point during the process of manufacturing a silver halide emulsion as long as physical ripening can be prevented. Sensitizing dyes, however, are most preferably added to a silver halide emulsion before chemical sensitization is started. These compounds not only prevent physical ripening but have functions as an antifoggant and a sensitizer, in the case of a compound having a mercapto group, and as a spectral sensitizer, in the case of a sensitizing dye. Therefore, if physical ripening is prevented by some other means, these compounds can be added to an emulsion after chemical sensitization and immediately before coating.

Some of these adsorbents have properties of particularly increasing the growth rate of (111) faces or decreasing the growth rate of (100) faces. Adding such an adsorbent before completion of grain formation is very preferable because it not only prevents physical ripening but effectively increases the pAg required to form the substantially perfect cubes of the present invention.

Among compounds having a mercapto group, a nitrogen-containing heterocyclic compound having a mercapto group is most preferable.

In the present invention, as described above, sensitizing dyes are usable as physical ripening inhibitors or crystal habit regulators capable of forming cubes at a high pAg in the step of grain formation. Sensitizing dyes, however, are originally used for the purpose of extending the wavelength of radiation, to which a silver halide emulsion can be sensitive, from the intrinsic region to a long-wavelength region. The present inventor has made researches and found that the effect of improving photographic properties was small even by increasing the perfection ratio of a cube when no spectral sensitization using sensitizing dyes was performed, and that a very large effect of the use of the substantially perfect cubes could not be obtained unless spectral sensitization using sensitizing dyes was performed. In the present invention, therefore, spectral sensitization using sensitizing dyes is essential.

Dyes usable in the present invention involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei may be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

Emulsions may contain, in addition to the sensitizing dyes, dyes having no spectral sensitizing effect or substances not essentially absorbing visible light and presenting supersensitization.

The addition amount may be $4\times10^{-6}$ to $8\times10^{-3}$ mol per mol of a silver halide. However, for a more preferable silver halide grain size of 0.5 to 1.0 μm, an addition amount of about $5\times10^{-5}$ to $2\times10^{-3}$ mol is more effective.

Physical ripening also occurs in the step of desalting. For the desalting purpose, the emulsion of the present invention is preferably washed with water and dispersed in a protective colloid that is newly prepared. The temperature of water for washing is preferably selected from 5° C. to 50° C. To prevent physical ripening in the desalting step, the desalting is performed in the presence of the adsorbents described above or with the pAg controlled. The desalting is performed at a pAg of 5 to 10 for normal emulsions. The solubility of a silver halide can be calculated from the temperature, the pKsp, the dissociation constants and the formation enthalpy of AgBr, $AgBr_2$, $AgBr_3$, and $AgBr_4$, described in James et al., "The Theory of Photographic Process." Within the range of temperature of 30° C. to 50° C. in the regular desalting step, the solubility of a silver halide is lowest near pAg =8. To prevent exposure of (111) faces, the pAg is preferably as low as possible. For these reasons, in order to prevent physical ripening by controlling the pAg during desalting of an emulsion of the present invention, the pAg is preferably set between 7 and 8.

Also, the pH during washing is preferably selected between 2 and 10. The washing method can be selected from a noodle washing process, a dialysis process using a semipermeable membrane, a centrifugal separation process, a coagulation sedimentation process, and an ion exchange process. The coagulation sedimentation process can be selected from a method of using sulfate, a method of using a water-soluble polymer, and a method of using a gelatin derivative.

Grains are physically ripened also in chemical sensitization. The chemical sensitization is commonly performed at a temperature of 40° C. to 90° C. Grains are susceptible to physical ripening especially when a chemical sensitizer containing a silver halide solvent, such as thiocyanate, is used. Although the chemical sensitization can be performed at a pAg of 7 to 8 as in the desalting, it is preferable to perform the chemical sensitization at a pAg of 5 to 11 in the presence of the adsorbents described above. It is known that the presence of adsorbents in the chemical sensitization is preferable in limiting the site at which the chemical sensitization is performed as well as preventing physical ripening or obtaining the sensitizing effects of the individual compounds.

The silver halide emulsion of the present invention preferably has a distribution or a structure associated with a halogen composition in its grains. A typical example of such a grain is a core-shell or double structure grain having different halogen compositions in its interior and surface layer as disclosed in, e.g., JP-B-43-13162, JP-A-61-215540, JP-A-60-222845, JP-A-60-143331, or JP-A-61-75337. The structure need not be a simple double structure but may be a triple structure or a multiple structure larger than the triple structure as disclosed in JP-A-60-222844. It is also possible to bond a thin silver halide having a different composition on the surface of these grains.

In the case of, e.g., a silver bromoiodide grain having any of the above structures, the silver iodide content at the core may be higher than that of the shell. In contrast to this, the silver iodide content at the core may be low while that at the shell is high.

When the equivalent-sphere diameter of a grain is 0.5 μm or less, dislocation lines of the grain can be observed by a transmission electron microscope. The silver halide grain of the present invention either may or may not have dislocation lines. When the substantially perfect cube of the present invention has dislocation lines, the cube becomes difficult to manufacture because it becomes more susceptible to physical ripening. However, the cube may contain dislocation lines in accordance with the intended use.

Dislocations can be introduced linearly with respect to a specific direction of a crystal orientation of a grain or curved with respect to that direction. It is also possible to selectively introduce dislocations throughout an entire grain or only to a particular portion of a grain, e.g., the fringe portion of a grain. When dislocations are limitedly introduced to the fringe portion, dislocation lines of each grain can be counted by observing the grain by using an electron microscope. In the silver halide grains of the present invention, it is preferable that 30 or less, and more preferably 10 or less dislocation lines be observed per grain.

The grain size of a silver halide emulsion used in the present invention can be evaluated in terms of the equivalent-sphere diameter of the volume of a grain, calculated from the length of an edge of a cubic emulsion by using an electron microscope, or the equivalent-sphere diameter of the volume, obtained by a Coulter counter method. It is possible to selectively use various grains from a very fine grain having an equivalent-sphere diameter of 0.05 μm or less to a large grain having that of 10 μm or more. In the case of a silver halide of the present invention, the equivalentsphere diameter is preferably 0.05 to 2.0 μm, and more preferably 0.05 to 1.0 μm.

A silver halide emulsion for use in the present invention is preferably a monodisperse silver halide emulsion. "Monodisperse" means that the variation coefficient of equivalent-sphere diameters of an emulsion is 0.20 or less when observed by an electron microscope. That is, an emulsion in which the value (variation coefficient) of a quotient obtained by dividing a standard deviation s of a distribution of equivalent-sphere diameters by an average equivalent-sphere diameter r is 0.20 or less is the monodisperse emulsion.

In order for a light-sensitive material to satisfy its target gradation, two or more monodisperse silver halide emulsions having different grain sizes and containing at least one of silver halide emulsions of the present invention can be mixed in a single emulsion layer having essentially the same color sensitivity or can be coated as different layers. It is also possible to mix two or more types of polydisperse silver halide emulsions or monodisperse emulsions together with polydisperse emulsions in a single layer, or to coat them as different layers.

It is advantageous to use gelatin as a protective colloid for use in preparation of emulsions of the present invention or as a binder for other hydrophilic colloid layers. However, other hydrophilic colloids can also be used in place of gelatin. A combination of a compound represented by Formula (1) and gelatin is also preferable.

Examples of the hydrophilic colloid are protein, such as a gelatin derivative, a graft polymer of gelatin and another high polymer, albumin, and casein; a sugar derivative, such as hydroxyethylcellulose, carboxymethylcellulose, a cellulose derivative such as cellulose sulfates, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

In the preparation of an emulsion of the present invention, it is preferable to make salt of metal ion exist during grain formation, desalting, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous hydrogen halide solution (e.g., HCl and HBr) or an alkali halide (e.g., KCl, NaCl, Kbr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to add a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In formation of silver halide grains of the present invention, at least one of sulfur sensitization, selenium sensitization, gold sensitization, palladium sensitization or noble metal sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of them. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mole, and more preferably $1\times10^{-5}$ to $5\times10^{-7}$ mole. A preferable amount of a palladium compound is $1\times10^{-3}$ to $5\times10^{-7}$. A preferable amount of a thiocyan compound or a selenocyan compound is $5\times10^{-2}$ to $1\times10^{-6}$.

An amount of a sulfur sensitizer used for silver halide grains of the present invention is preferably $1\times10^{-4}$ to $1\times10^{-7}$ mole, and more preferably $1\times10^{-5}$ to $5\times10^{-7}$ mole per mole of a silver halide.

Selenium sensitization is a preferable sensitizing method for emulsions of the present invention. Known labile selenium compounds can be used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

Photographic emulsions used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7-)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling the crystal habit of grains, decreasing the grain size, decreasing the solubility of grains, controlling the chemical sensitization, and controlling the arrangement of dyes.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

A preferable silver halide contained in photographic emulsion which can be use together with the emulsion of the present invention is silver bromoiodide, silver chloroiodide, or silver chlorobromoiodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion which can be used together may have regular crystals such as cubic, octahedral, or tetradecahedral crystals, irregular crystals such as spherical, or tabular crystals, crystals having defects such as twin planes, or composite shapes thereof.

The silver halide which can be used together may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used together with the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used together with the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure of the silver halide which can be used together may be uniform, may have different halogen compositions in the interior and the surface thereof, or may be a layered structure. Alternatively, silver halides having different compositions may be joined by an epitaxial Junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of 40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Patent 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, bis(1,1-di-ethylpropyl)phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl)sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 51, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl-)aniline, 4-amino-3-methyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and the sulfates, hydrochlorides and p-toluenesulfonates thereof. Of these compounds, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(3-hydroxybutyl)aniline, and the sulfates, hydrochlorides and p-toluenesulfonates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof. The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds descried in West German Patents 966,410 and 2,748,430; polyamine compounds described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

In the present invention, 0.1 to 10 moles, per liter, of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, EiseigiJutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoanilinebased compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

The present invention has been described in detail above. The greatest characteristic feature of the present invention is to use the substantially perfect cubes. As described in "Description of the Related Art," various researches have been made on cubes, but no workers have focused attention on the perfection of a cube unlike the present inventor. The present inventor has made extensive studies and found that formation of more perfect cubes is necessary to bring out the performance of cubes. When the corners of a cube are rounded by dissolution or (111) faces are exposed, the results are low-sensitivity, lowt-contrast photographic properties. This mechanism, however, has not been clearly uncovered yet.

The present invention will be described in greater detail below by way of its examples, but the invention is not limited to these examples.

EXAMPLE 1

The pAg dependency of growth will be described.

<Preparation of seed crystals 1>

1 kg of gelatin was dissolved in 25 l of water and the pH was adjusted to 5.7, to prepare a reaction solution at 45° C. 5.2 l of an aqueous 13.5% silver nitrate solution and 5.2 l of an aqueous 10.2% potassium bromide solution were added to the reaction solution at a rate of 100 cc/min for ten minutes and 600 cc/min for seven minutes. In addition, an aqueous solution containing 2,250 g of silver nitrate was added to the resultant solution over 68 minutes while the addition amount was increased by 7.5 cc per minute. Simultaneously, an aqueous potassium bromide solution was added to maintain the pAg at 6.7. The resultant emulsion was washed with water by a coagulation sedimentation process while the pAg was kept at 7.2, and 475 g of gelatin were added to redisperse the emulsion. The results were seed crystals 1 with a diameter as sphere of 0.14 μm. The yield was 20 kg.

When the perfection ratio of this seed crystal emulsion was measured, the emulsion was found to be a cubic emulsion with a perfection ratio of 0,975.

<Preparation of emulsion 1A>

45 g of the seed crystals 1 and 45 g of gelatin were dispersed in 1,450 cc of water at 70° C. and the pH was adjusted to 4.5, to prepare a reaction solution. 1,000 cc of an aqueous 1.542M silver nitrate solution were added to the reaction solution over 60 minutes. Simultaneously, an aqueous solution mixture of potassium bromide and potassium iodide, that contained 2 mol % of iodide, was added to maintain the pAg at 9.0. Note that the addition rate was increased linearly with respect to time such that the final addition rate was 12,755 times that at the beginning. Subsequently, a sensitizing dye I-1 was added in an amount of $7.8\times10^{-4}$ per mol of silver, and the resultant solution was ripened for 20 minutes.

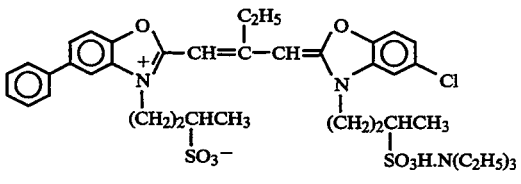

I-1

At a temperature of 35° C., the resultant emulsion was washed with water twice by a coagulation sedimentation process using a water-soluble polymer while the pAg was controlled to 7.5. 100 g of gelatin were added to redisperse the emulsion under conditions of pAg=8.4 and pH=6.4. The result was an octahedral emulsion with a diameter as sphere of 0.50 μm.

Subsequently, the emulsion was heated up to 55° C., and potassium thiocyanate was added in an amount of $1\times10^{-3}$ mol per mol of silver. Thereafter, chemical sensitization was performed optimally by adding chloroauric acid, sodium thiosulfate, and dimethylselenourea, yielding an emulsion 1A.

<Preparation of emulsion 1B>

An emulsion 1B was prepared following the same procedures as for the emulsion 1A except that the addition of an aqueous silver nitrate solution was performed while the pAg was controlled to 8.0 during grain formation. The result was a tetradecahedral grain in which a (111) face and a (100) face had nearly the same areas.

<Preparation of emulsion 1C>

An emulsion 1C was prepared following the same procedures as for the emulsion 1A except that the addition of an aqueous silver nitrate solution was performed while the pAg was controlled to 7.0 during grain formation. The results were tetradecahedral grains in which (100) faces were dominant. The perfection ratio was found to be 0.645.

<Preparation of emulsion 1D>

An emulsion 1D was prepared following the same procedures as for the emulsion 1A except that the addition of an aqueous silver nitrate solution was performed while the pAg was controlled to 6.6 during grain formation. The result was a cubic emulsion with a perfection ratio of 0.856.

<Preparation of emulsion 1E>

An emulsion 1E was prepared following the same procedures as for the emulsion 1A except that the addition of an aqueous silver nitrate solution was performed while the pAg was controlled to 6.3 during grain formation and an aqueous 0.6M silver nitrate solution was used in order to stabilize the control. The addition flow rate was controlled such that the addition amount of silver nitrate per unit time was the same as in the case of the emulsion 1A. The result was a cubic emulsion with a perfection ratio of 0.968. The substantially perfect cubes accounted for 90% or more of the total projected area.

<Preparation of emulsion 1F>

An emulsion 1F was prepared following the same procedures as for the emulsion 1A except that the addition of an aqueous silver nitrate solution was performed while the pAg was controlled to 5.7 during grain formation and an aqueous 0.6M silver nitrate solution was used in order to stabilize the control. The addition flow rate was controlled such that the addition amount of silver nitrate per unit time was ¼ that in the case of the emulsion 1A in order to stabilize the control, further. The result was a cubic emulsion with a perfection ratio of 0.997. The substantially perfect cubes accounted for 90% or more of the total projected area.

Each emulsion has a silver iodide content of 1.95 mol %.

The color emulsions 1A to 1F prepared as described above were coated on TAC (triacetyl cellulose) supports under the coating conditions below.

Emulsion coating conditions (1) Emulsion layer

-continued

Emulsion . . several different emulsions (the above spectral sensitized emulsions)
(silver content $2.1 \times 10^{-2}$ mol/m$^2$)
Coupler ($1.5 \times 10^{-3}$ mol/m$^2$)

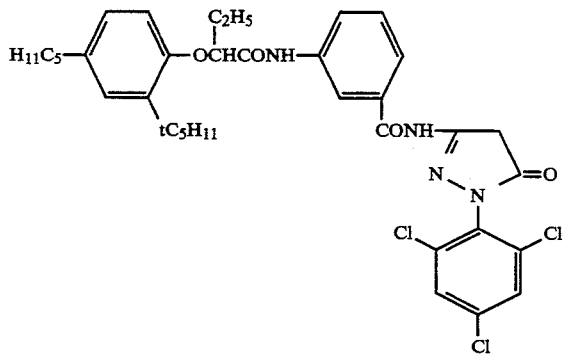

Tricresylphosphate (1.10 g/m$^2$)
Gelatin (2.3 g/m$^2$)
(2) Protective layer
2,4-dichloro-6-hydroxy-s-triazine sodium salt (0.08 g/m$^2$)
Gelatin (1.8 g/m$^2$)

These samples were left to stand at a temperature of 40° C. and a relative humidity of 70% for 14 hours, exposed through a yellow filter (available from Fuji Photo Film Co., Ltd.) and a continuous wedge for 1/100 second, and subjected to the following color development.

| Step | (Processing method) Time | Temperature |
|---|---|---|
| Color development | 2 min. 45 sec. | 38° C. |
| Bleaching | 3 min. 00 sec. | 38° C. |
| Washing | 30 sec. | 24° C. |
| Fixing | 3 min. 00 sec. | 38° C. |
| Washing (1) | 30 sec. | 24° C. |
| Washing (2) | 30 sec. | 24° C. |
| Stabilization | 30 sec. | 38° C. |
| Drying | 4 min. 20 sec. | 55° C. |

The compositions of the individual processing solutions are given below.

| | (g) |
|---|---|
| (Color developing solution) | |
| Diethylenetriaminepentaacetate | 1.0 |
| 1-hydroxyethylidene-1,1-diphosphonic acid | 3.0 |

-continued

| | (g) |
|---|---|
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-ethyl-N-β-hydroxylethylamino)-2-methylaniline sulfate | 4.5 |
| Water to make | 1.0 l |
| pH | 10.05 |
| (Bleaching solution) | |
| Ferric ammonium ethylenediamine-tetraacetate trihydrate | 100.0 |
| Disodium ethylenediaminetetraacetate | 10.0 |
| 3-mercapto-1,2,4-triazole | 0.08 |
| Ammonium bromide | 140.0 |
| Ammonium nitrate | 30.0 |
| Ammonia water (27%) | 6.5 ml |
| Water to make | 1.0 l |
| pH | 6.0 |
| (Fixing solution) | |
| Disodium ethylenediaminetetraacetate | 0.5 |
| Ammonium sulfite | 20.0 |
| Ammonium thiosulfate aqueous solution (700 g/l) | 290.0 ml |
| Water to make | 1.0 l |
| pH | 6.7 |
| (Stabilizing solution) | |
| Sodium p-toluenesulfinate | 0.03 |
| Polyoxyethylene-p-monononylphenylether (average polymerization degree 10) | 0.2 |
| Disodium ethylenediaminetetraacetate | 0.05 |
| 1,2,4-triazole | 1.3 |
| 1,4-bis(1,2,4-triazole-1-ylmethyl)piperazine | 0.75 |
| Water to make | 1.0 l |
| pH | 8.5 |

Density measurement was performed for each processed sample by using a green filter, and the sensitivity and the value of fog of each sample was obtained from the measurement result. Note that the sensitivity was represented by a relative value of the reciprocal of an exposure amount by which a density of fog+0.2 was given. The gradation was obtained from the slope of a line connecting a point at which density 1 was given and a point at which density 2 was given on the characteristic curve in which the reciprocal of an exposure amount was plotted on the abscissa. In addition, excess exposure was given to each sample to obtain the maximum color density. These results are summarized in Table 1 below.

TABLE 1

| Emulsion No. | pAg in growth | Crystal habit | Perfection ratio | Sensitivity | Fog | γ | Color density | Remarks |
|---|---|---|---|---|---|---|---|---|
| Emulsion 1A | 9.0 | Octahedron | — | 100 | 0.14 | 0.5 | 2.6 | Comparative example |
| Emulsion 1B | 8.0 | Tetradecahedron | — | 120 | 0.14 | 0.8 | 2.8 | Comparative example |
| Emulsion 1C | 7.0 | Tetradecahedron | 0.645 | 125 | 0.13 | 1.4 | 2.8 | Comparative example |
| Emulsion 1D | 6.6 | Cube | 0.856 | 156 | 0.15 | 1.8 | 3.2 | Comparative example |
| Emulsion 1E | 6.3 | Cube | 0.968 | 287 | 0.15 | 2.1 | 3.6 | Present invention |
| Emulsion 1F | 5.7 | Cube | 0.997 | 298 | 0.15 | 2.2 | 3.6 | Present invention |

As is apparent from Table 1, a cubic emulsion can be formed even by growth at pAg=6.6 and has very high performance, such as a high sensitivity, a high γ, and a high color density, compared to an octahedral or tetradecahedral emulsion. Nevertheless, not all potentials of cubes are brought out by this emulsion. Each cubic emulsion of the present invention, grown at a lower pAg and having a higher perfection ratio, has higher performance, i.e., a higher sensitivity, a higher γ, and a higher color density, than those of the cubes grown at pAg 6.6.

EXAMPLE 2

The silver iodide content dependency will be described.

<Preparation of emulsion 2A>

45 g of the seed crystals 1 and 45 g of gelatin were dispersed in 1,450 cc of water at 60° C. and the pH was adjusted to 4.5, to prepare a reaction solution. After 9.59 g of the sensitizing dye I-1 were added to the reaction solution, 0.05 g of a silver halide solvent II-1 and 0.001 g of an oxidizer II-2 were added to the resultant solution.

II-1

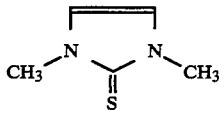

II-2

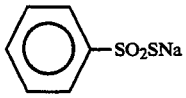

Subsequently, 294 cc of an aqueous 0.5M silver nitrate solution were added to the solution over 25 minutes while the pAg was controlled to 6.0 by using an aqueous potassium bromide solution (first stage). In addition, 780 cc of an aqueous 1.542M silver nitrate solution was added to the resultant solution over 98 minutes while the pAg was controlled to 6.3 by using an aqueous potassium bromide solution (second stage).

Note that the addition rate was increased linearly with respect to time such that the final addition rate was 12.755 times that at the beginning.

At a temperature of 35° C., the resultant emulsion was washed with water twice by a coagulation sedimentation process using a water-soluble polymer while the pAg was controlled to 7.5. 100 g of gelatin were added to redisperse the emulsion under conditions of pAg=8.4 and pH=6.4. The result was a pure silver bromide cubic emulsion with a diameter as sphere of 0.50 μm.

Subsequently, the emulsion was heated up to 55° C., and potassium thiocyanate was added in an amount of $1\times10^{-3}$ mol per mol of silver. Thereafter, chemical sensitization was performed optimally by adding chloroauric acid, sodium thiosulfate, and dimethylselenourea, yielding an emulsion 2A. The perfection ratio was 0.994.

<Preparation of emulsions 2B–2G>

Cubic emulsions 2B to 2G having different silver iodide contents were prepared following the same procedures as for the emulsion 2A except that the aqueous potassium bromide solution added in the second stage was allowed to contain potassium iodide in amounts by which the final grains gained their respective target silver iodide contents. The pAg during growth of each emulsion was so selected, in accordance with its silver iodide content, as to permit the emulsion to have a perfection ratio of 0.96 or more. In each of the emulsions 2C to 2G, the essentially perfect cubes occupied 90% or more of the total projected area.

Following the same procedures as in Example 1, coating, exposure, development, and measurement were performed for the emulsions 2A to 2G thus prepared, obtaining the perfection ratio, the sensitivity, the fog, the γ, and the maximum color density of each emulsion. The results are summarized in Table 2 below.

TABLE 2

| Emulsion No. | Silver iodide content (mol %) | pAg in growth (second stage) | Perfection ratio | Sensitivity | Fog | γ | Color density | Remarks |
|---|---|---|---|---|---|---|---|---|
| Emulsion 2A | 0 | 6.3 | 0.994 | 100 | 0.15 | 2.3 | 3.7 | Comparative example |
| Emulsion 2B | 0.4 | 6.3 | 0.989 | 108 | 0.15 | 2.3 | 3.7 | Comparative example |
| Emulsion 2C | 0.7 | 6.3 | 0.984 | 134 | 0.16 | 2.3 | 3.7 | Present invention |
| Emulsion 2D | 1.7 | 6.3 | 0.982 | 145 | 0.18 | 2.2 | 3.6 | Present invention |
| Emulsion 2E | 2.3 | 6.1 | 0.984 | 158 | 0.18 | 2.2 | 3.6 | Present invention |
| Emulsion 2F | 4.1 | 5.8 | 0.990 | 145 | 0.16 | 2.1 | 3.5 | Present invention |
| Emulsion 2G | 7.3 | 5.5 | 0.961 | 143 | 0.16 | 1.8 | 3.4 | Present invention |

As can be seen from Table 2, although perfect cubes can be formed at any silver iodide content, the sensitivity is high especially when the silver iodide content is 0.5 mol % or more.

EXAMPLE 3

The flow rate dependency of grain growth, the pAg dependency of washing, and the addition timing dependency of sensitizing dyes will be described.

<Preparation of emulsion 3A>

90 g of the seed crystals 1 and 45 g of gelatin were dispersed in 1,000 cc of water at 70° C. and the pH was adjusted to 4.5, to prepare a reaction solution. 1,000 cc of an aqueous 1.542M silver nitrate solution were added to the reaction solution at a constant flow rate over 180 minutes. Simultaneously, an aqueous solution mixture of potassium bromide and potassium iodide, that contained 3 mol % of iodide, was added with the pAg controlled to 6.0. The perfection ratio measured immediately after the grain formation was 0.891.

At a temperature of 35° C., the resultant emulsion was washed with water twice by a coagulation sedimentation process using a water-soluble polymer while the pAg was controlled between 7 and 8. 100 g of gelatin were added to redisperse the emulsion under conditions of pAg=7.5 and pH=6.4. The result was a cubic emulsion with a diameter as sphere of 0.40 μm. The perfection ratio was found to be 0.89.

Subsequently, the emulsion was heated up to 55° C., and sensitizing dyes I-1, I-2, and I-3 were added in amounts of $7.62\times10^{-4}$ mol, $1.54\times10^{-4}$ mol, and $2.15\times10^{-5}$ mol, respectively, per mol of silver nitrate. Thereafter, potassium thiocyanate was added in an amount of $1\times10^{-3}$ mol per mol of silver, and the pAg was controlled to 8.4. Chemical sensitizing was performed optimally by adding chloroauric acid, sodium thiosulfate, and dimethylselenourea, yielding an emulsion 3A. The perfection ratio after the chemical sensitization was 0.885.

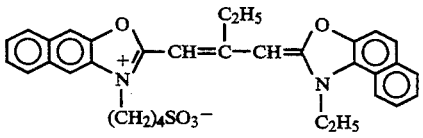

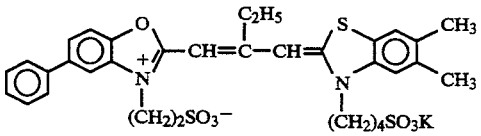

<Preparation of emulsion 3B>

An emulsion 3B was prepared following the same procedures as for the emulsion 3A except that the addition time of silver nitrate was changed from 180 minutes to 90 minutes. As in the preparation of the emulsion A, the perfection ratio was measured at three points, immediately after grain formation, immediately after dispersion after washing, and after chemical sensitization. The perfection ratio after chemical sensitization was 0.963.

<Preparation of emulsion 3C>

An emulsion 3C was prepared following the same procedures as for the emulsion 3B except that the pAg during washing was controlled between 8 and 9. As in the preparation of the emulsion A, the perfection ratio was measured at three points, immediately after grain formation, immediately after dispersion after washing, and after chemical sensitization. The perfection ratio after chemical sensitization was 0.920.

<Preparation of emulsion 3D>

An emulsion 3D was prepared following the same procedures as for the emulsion 3B except that the pAg during washing was controlled between 6 and 7. As in the preparation of the emulsion A, the perfection ratio was measured at three points, immediately after grain formation, immediately after dispersion after washing, and after chemical sensitization. The perfection ratio after chemical sensitization was 0.931.

<Preparation of emulsion 3E>

An emulsion 3E was prepared following the same procedures as for the emulsion 3A except that the addition time of silver nitrate was changed from 180 minutes to 67 minutes and the addition rate was increased linearly with respect to time such that the final flow rate was 8.163 times that at the beginning. As in the preparation of the emulsion A, the perfection ratio was measured at three points, immediately after grain formation, immediately after dispersion after washing, and after chemical sensitization. The perfection ratio after chemical sensitization was 0.993.

<Preparation of emulsion 3F>

An emulsion 3F was prepared following the same procedures as for the emulsion 3E except that the addition timing of sensitizing dyes was changed from before chemical sensitizing to after chemical sensitization. The perfection ratio was measured at four points, immediately after grain formation, immediately after dispersion after washing, and immediately after chemical sensitization, as in the preparation of the emulsion 3A, and after the addition of the sensitizing dyes. The perfection ratio remained unchanged at 0.732 immediately after the chemical sensitization and after the addition of the sensitizing dye.

<Preparation of emulsion 3G>

An emulsion 3G was prepared following the same procedures as for the emulsion 3E except that the pAg during washing was controlled between 8 and 9. As in the preparation of the emulsion A, the perfection ratio was measured at three points, immediately after grain formation, immediately after dispersion after washing, and after chemical sensitization. The perfection ratio after chemical sensitization was 0.922.

Each emulsion has a silver iodide content of 2.86 mole %.

Following the same procedures as in Example 1, coating, exposure, development, and measurement were performed for the emulsions 3A to 3G prepared as described above, obtaining the sensitivity, the fog, the γ, and the maximum color density of each emulsion. These results together with the measurement results of the perfection ratios at the three points are summarized in Table 3 below. Note that in each of the emulsions 3B and 3E, the substantially perfect cubes accounted for 90% or more of the total projected area.

TABLE 3

| Emulsion No. | Growth time | Perfection ratio immediately after grain formation | pAg in washing | Perfection ratio immediately after dispersion after washing | Addition timing of sensitizing dyes | Perfection ratio (final) | Sensitivity | Fog | γ | Color density | Remarks |
|---|---|---|---|---|---|---|---|---|---|---|---|
| Emulsion 3A | 180 | 0.891 | 7–8 | 0.890 | before chemical sensatization | 0.885 | 100 | 0.15 | 1.3 | 3.1 | Comparative example |
| Emulsion 3B | 90 | 0.973 | 7–8 | 0.971 | before chemical sensitization | 0.963 | 214 | 0.17 | 2.3 | 3.7 | Present invention |
| Emulsion 3C | 90 | 0.973 | 8–9 | 0.924 | before chemical sensitization | 0.920 | 110 | 0.16 | 1.5 | 3.5 | Comparative example |
| Emulsion 3D | 90 | 0.973 | 6–7 | 0.934 | before chemical sensitization | 0.931 | 121 | 0.16 | 1.6 | 3.6 | Comparative example |
| Emulsion 3E | 67 | 0.994 | 7–8 | 0.994 | before | 0.993 | 258 | 0.18 | 2.3 | 3.7 | Present |

TABLE 3-continued

| Emulsion No. | Growth time | Perfection ratio immediately after grain formation | pAg in washing | Perfection ratio immediately after dispersion after washing | Addition timing of sensitizing dyes | Perfection ratio (final) | Sensitivity | Fog | γ | Color density | Remarks |
|---|---|---|---|---|---|---|---|---|---|---|---|
| | | | | | chemical sensitization | | | | | | invention |
| Emulsion 3F | 67 | 0.994 | 7–8 | 0.994 | after chemical sensitization | 0.732 | 45 | 0.12 | 0.6 | 2.3 | Comparative example |
| Emulsion 3G | 67 | 0.994 | 8–9 | 0.924 | before chemical sensitization | 0.922 | 115 | 0.14 | 1.6 | 3.2 | Comparative example |

As can be seen from Table 3, even if grains are perfect cubes immediately after grain formation, when the pAg during washing is set at a value other than 7 to 8 in the absence of adsorbents or chemical sensitization including addition of potassium thiocyanate is performed in the absence of adsorbents, the final grains assume cubes with chipped corners, decreasing the perfection ratio, and resulting in a low sensitivity, a low γ, and a low color density. Table 3 also reveals that even if the pAg of grain growth is the same, when the addition rate is too low, this increases the possibility that grains are physically ripened, yielding cubes with chipped corners.

Example 3 demonstrates that the whole process must be carried out with enough care in order to manufacture the substantially perfect cubes of the present invention.

EXAMPLE 4

The silver chloride content dependency and the comparision with the silver chloride corner epitaxy will be described.

<Preparation of emulsion 4A>

52 g of gelatin were dispersed in 1,000 cc of water at 60° C. and the pH was adjusted to 4.5, to prepare a reaction solution. 280 cc of an aqueous 0.2M silver nitrate solution and an aqueous potassium bromide solution were added to the reaction solution over eight minutes (first stage). Subsequently, 500 cc of an aqueous 1.542M silver nitrate solution and an aqueous solution mixture of potassium bromide and potassium iodide, that contained 1.7 mol % of iodide, were added to the resultant solution over 87 minutes while the pAg was controlled to 6.0 (second stage). In the addition of the aqueous silver nitrate solution, the addition rate was increased linearly with respect to time such that the final flow rate was three times that at the beginning.

Subsequently, 1,030 cc of an aqueous 0.8M silver nitrate solution were added to the resultant solution over 30 minutes while the pAg was kept at 5.8 by using an aqueous halide solution (third stage). The halogen composition of the aqueous halide solution was that iodide=2.0 mol % and bromide=98 mol %.

After the grain formation, sensitizing dyes I-4, I-5, and I-6 were added in amounts of $7.4\times10^{-4}$ mol, $7.4\times10^{-4}$ mol, and $2.2\times10^{-5}$ mol, respectively, per mol of silver nitrate to ripen the solution for ten minutes.

I-4

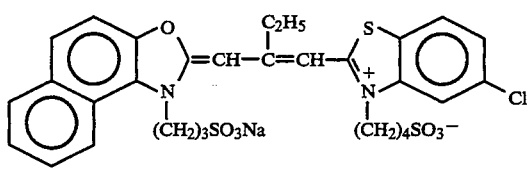

I-5

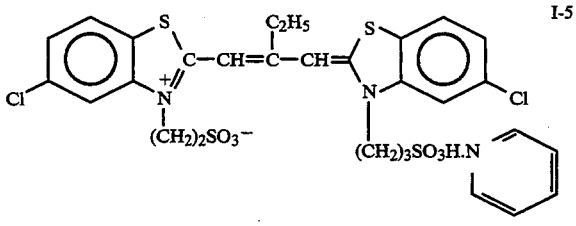

I-6

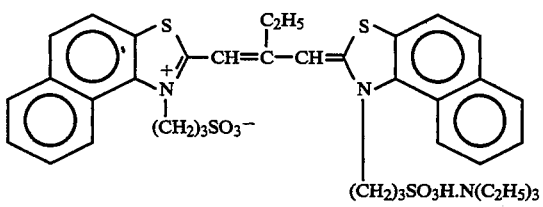

The perfection ratio at that time was found to be 0.997.

At a temperature of 35° C., the resultant emulsion was washed with water twice by a coagulation sedimentation process using a water-soluble polymer while the pAg was controlled between 7 and 8. 100 g of gelatin were added to redisperse the emulsion under conditions of pAg=7.5 and pH=6.4. The result was a cubic emulsion with a diameter as sphere of 0.27 μm.

Subsequently, the emulsion was heated up to 55° C., and potassium thiocyanate was added in an amount of $1\times10^{-3}$ mol per mol of silver. Thereafter, the pAg was controlled to 8.4, and chemical sensitization was performed optimally by adding chloroauric acid, sodium thiosulfate, and dimethylselenourea, yielding an emulsion 4A. The perfection ratio measured after the chemical sensitization was 0.996.

<Preparation of emulsion 4B>

An emulsion 4B was prepared following the same procedures as for the emulsion 4A except that the halogen composition of the aqueous halide solution in the third stage was changed to iodide=2.0 mol %, chloride=3.4 mol %, and bromide=94.6 mol %. The silver chloride content measured immediately after the grain formation was 1.2 mol %. As in the preparation of the emulsion 4A, the perfection ratio was measured immediately after the second stage, immediately after the grain formation and before the washing (immediately after spectral sensitization performed by addition of sensitizing dyes after the grain formation), and after the chemical sensitization.

<Preparation of emulsion 4C>

An emulsion 4C was prepared following the same procedures as for the emulsion 4A except that the halogen composition of the aqueous halide solution in the third stage was changed to iodide=2.0 mol %, chloride=4.5 mol %, and bromide=93.5 mol %. The silver chloride content measured immediately after the grain formation was 2.3 mol %. As in the preparation of the emulsion 4A, the perfection ratio was measured immediately after the second stage, immediately after the spectral sensitization performed by addition of sensitizing dyes after the grain formation, and after the chemical sensitization.

<Preparation of emulsion 4D>

An emulsion 4D was prepared following the same procedures as for the emulsion 4A except that the halogen composition of the aqueous halide solution in the third stage was changed to iodide=2.0 mol %, chloride=6.1 mol %, and bromide=91.9 mol %. The silver chloride content measured immediately after the grain formation was 3.5 mol %. As in the preparation of the emulsion 4A, the perfection ratio was measured immediately after the second stage, immediately after the spectral sensitization performed by addition of sensitizing dyes after the grain formation, and after the chemical sensitization.

<Preparation of emulsion 4E>

A cubic emulsion with a diameter as sphere of 0.27 μm, in which silver chloride was localized to the corners of grains, was prepared in accordance with Example 1 of JP-A-55-124139. The perfection ratio measured before chemical sensitization was 0.999, and the silver chloride content was found to be 3.5 mol %. The chemical sensitization was performed as follows. The emulsion was heated up to 55° C., and the sensitizing dyes I-4, I-5, and I-6 were added in amounts of $7.4\times10^{-4}$ mol, $7.4\times10^{-4}$ mol, and $2.2\times10^{-5}$ mol, respectively, per mol of silver nitrate to ripen the emulsion for ten minutes. After potassium thiocyanate was added in an amount of $1\times10^{-3}$ mol per mol of silver, the pAg was controlled to 8.4, and chemical sensitization was performed optimally by adding chloroauric acid, sodium thiosulfate, and dimethylselenourea, yielding an emulsion 4E. The perfection ratio measured after the chemical sensitization was 0.912.

Each emulsion has a silver iodide content of 1.80 mol %.

Following the same procedures as in Example 1, coating, exposure, development, and measurement were performed for the emulsions 4A to 4E thus prepared, obtaining the sensitivity, the fog, and the γ of each emulsion. The results and the data of the perfection ratio are summarized in Table 4 below. Note that as the perfection ratio of the emulsion 4E immediately after the second stage, the perfection ratio before formation of silver chloride epitaxy is listed. Note also that in each of the emulsions 4A, 4B, and 4C, the substantially perfect cubes occupied 90% or more of the total projected area.

TABLE 4

| Emulsion No | pAg in growth | Perfection ratio immediately after 2nd stage | Silver chloride epitaxy | Silver chloride content immediately after grain formation and before washing | Perfection ratio immediately after grain formation and before washing | Perfection ratio after chemical sensitization | Sensitivity | Fog | γ | Remarks |
|---|---|---|---|---|---|---|---|---|---|---|
| Emulsion 4A | 5.8 | 0.996 | None | 0 mol % | 0.997 | 0.996 | 100 | 0.15 | 2.3 | Present invention |
| Emulsion 4B | 5.8 | 0.996 | None | 1.2 mol % | 0.997 | 0.994 | 97 | 0.17 | 2.4 | Present invention |
| Emulsion 4C | 5.8 | 0.996 | None | 2.3 mol % | 0.999 | 0.972 | 95 | 0.20 | 2.4 | Present invention |
| Emulsion 4D | 5.8 | 0.996 | None | 3.5 mol % | 0.999 | 0.938 | 76 | 0.26 | 2.3 | Comparative example |
| Emulsion 4E | 6.8 | 0.886 | Formed | 3.5 mol % | 0.999 | 0.912 | 45 | 0.28 | 2.2 | Comparative example |

As is apparent from Table 4, when the silver chloride content is 3 mol % or less as in the present invention, perfect cubes are maintained even after chemical sensitization, yielding a high sensitivity. If, however, the silver chloride content exceeds 3 mol %, dissolution of the corners of grains occurs after chemical sensitization, and the results are reduction in perfection ratio and consequently a low sensitivity. In addition, silver chloride localized to the corners of grains also dissolves after chemical sensitization to reduce the perfection ratio, decreasing the sensitivity. To realize the effect of the present invention, therefore, the silver chloride content must be 3 mol % or less.

EXAMPLE 5

Effects of adding water-soluble polymers, ureas, and sensitizing dyes during grain formation will be described.

<Preparation of emulsion 5A>

52 g of gelatin were dispersed in 1,000 cc of water at 74° C. and pAg and pH were adjusted to 7.0 and 6.5, respectively, to prepare a reaction solution. 280 cc of an aqueous 0.2M silver nitrate solution and an equal molar quantity of an aqueous potassium bromide solution were added to the reaction solution over 20 minutes (first stage). Subsequently, 750 cc of an aqueous 1.542M silver nitrate solution were added to the resultant solution over 97 minutes (second stage). Simultaneously, an aqueous solution mixture of potassium bromide and potassium iodide, that contained 1.7 mol % of iodide, was added with the pAg controlled to 7.5. The hunting width at that time was ±0.03 in pAg. The addition rate of the aqueous silver nitrate solution was increased linearly with respect to time such that the final flow rate was seven times that at the beginning.

Subsequently, 780 cc of an aqueous 0.8M silver nitrate solution were added over 30 minutes while the pAg was kept at 7.5 by using an aqueous halide solution (third stage). The composition of the aqueous halide solution was that iodide=2.0 mol % and bromide=98 mol %.

After the grain formation, the sensitizing dyes I-4, I-5, and I-6 were added in amounts of $3.5\times10^{-4}$ mol, $3.5\times10^{-4}$ mol, and $1.2\times10^{-5}$ mol, respectively, per mol of silver nitrate to ripen the solution for ten minutes.

At a temperature of 35° C., the resultant emulsion was washed with water twice by a coagulation sedimentation process using a water-soluble polymer while the pAg was controlled between 7 and 8. 100 g of gelatin were added to redisperse the emulsion under conditions of pAg=7.5 and pH=6.4. The result was a tetradecahedral emulsion with a diameter as sphere of 0.53 μm.

Subsequently, the emulsion was heated up to 55° C., and potassium thiocyanate was added in amount of $1\times10^{-3}$ mol per mol of silver. The pAg was controlled to 8.4, and chemical sensitization was performed optimally by adding chloroauric acid, sodium thiosulfate, and dimethylselenourea, yielding an emulsion 5A. The perfection ratio measured after the chemical sensitization was 0.645.

<Preparation of emulsion 5B>

A cubic emulsion 5B was prepared following the same procedures as for the emulsion 5A except that the pAg for control was set at 6.0 in the second and third stages. The hunting width in the second stage was ±0.23 in pAg. The perfection ratio measured after the chemical sensitization was 0.995.

<Preparation of emulsion 5C>

A cubic emulsion 5C was prepared following the same procedures as for the emulsion 5A except that 3 g of a water-soluble synthetic polymer (exemplifed compound P-1 represented by Formula (1) mentioned earlier) were added after the addition in the first stage and the addition time in the second stage was prolonged from 97 minutes to 140 minutes. The hunting width in the second stage was ±0.01 in pAg. 97% of a silver amount of said silver halide emulsion are grown in the presence of the compound P-1. The perfection ratio measured after the chemical sensitization was 0.999.

<Preparation of emulsion 5D>

A cubic emulsion 5D was prepared following the same procedures as for the emulsion 5A except that 15 g of urea were added after the addition in the first stage and the pAg for control was set at 6.7 in the second and third stages. The hunting width in the second stage was ±0.13 in pAg. The perfection ratio measured after the chemical sensitization was 0.976.

<Preparation of emulsion 5E>

A cubic emulsion 5E was prepared following the same procedures as for the emulsion 5A except that the addition timing of the sensitizing dyes was changed from after grain formation to the end of the first stage, the pAg for control was set at 6.9 in the second and third stages, the addition time in the second stage was changed from 97 minutes to 140 minutes, and the addition time in the third stage was changed from 30 minutes to 50 minutes. The hunting width in the second stage was ±0.08 in pAg. The perfection ratio measured after the chemical sensitization was 0.986.

Each emulsion has a silver iodide content of 1.75 mol %.

Following the same procedures as in Example 1, coating, exposure, development, and measurement were performed for the emulsions 5A to 5E thus prepared, obtaining the sensitivity, the fog, and the γ of each emulsion. The results and the data of perfection ratio are summarized in Table 5 below. Note that in each of the emulsions 5B to 5E, the substantially perfect cubes occupied 90% or more of the total projected area.

TABLE 5

| Emulsion No. | Chemicals added in growth | pAg in growth | Hunting width (±pAg) | Perfection ratio | Sensitivity | Fog | γ | Remarks |
|---|---|---|---|---|---|---|---|---|
| Emulsion 5A | None | 7.5 | 0.03 | 0.645 | 100 | 0.12 | 1.1 | Comparative example |
| Emulsion 5B | None | 6 | 0.23 | 0.995 | 245 | 0.14 | 2.3 | Present invention |
| Emulsion 5C | P-1 | 7.5 | 0.01 | 0.999 | 255 | 0.13 | 2.3 | Present invention |
| Emulsion 5D | Urea | 6.7 | 0.13 | 0.976 | 202 | 0.15 | 2.2 | Present invention |
| Emulsion 5E | Sensitizing dyes | 6.9 | 0.08 | 0.986 | 237 | 0.13 | 2.3 | Present invention |

As can be seen from Table 5, when grain growth is performed in the presence of water-soluble synthetic polymers, ureas, or sensitizing dyes, the perfect cubes of the present invention can be formed at a relatively high pAg. Consequently, the hunting width in pAg control is reduced, and this makes it possible to manufacture the cubes even by a large-scale apparatus.

EXAMPLE 6

Effects of coated silver halide emulsion of the present invention in multiple layers will be described below.

Multiple layers having the compositions presented below were coated on a subbed triacetylcellulose film support to make a sample 6-1 as a multilayered color photographing material. (Compositions of light-sensitive layers)

The main materials used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |
| ExS: Sensitizing dye | |

The number corresponding to each component indicates the coating amount in units of g/m$^2$. The coating amount of a silver halide is represented by the amount of silver. The coating amount of each sensitizing dye is represented in units of moles per mole of a silver halide in the same layer.

| (Samples 6-1) | |
|---|---|
| 1st layer (Antihalation layer) | |
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| 2nd layer (Interlayer) | |
| Emulsion G | silver 0.065 |
| 2,5-di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (Low-speed red-sensitive emulsion layer) | |
| Emulsion A | silver 0.25 |
| Emulsion C | silver 0.25 |
| ExS-1 | $4.5 \times 10^{-4}$ |
| ExS-2 | $1.5 \times 10^{-5}$ |
| ExS-3 | $4.5 \times 10^{-4}$ |
| ExC-1 | 0.17 |
| ExC-3 | 0.030 |
| ExC-4 | 0.10 |
| ExC-5 | 0.005 |
| ExC-7 | 0.0050 |
| ExC-8 | 0.020 |
| Cpd-2 | 0.025 |
| HBS-1 | 0.10 |
| Gelatin | 0.87 |
| 4th layer (Medium-speed red-sensitive emulsion layer) | |
| Emulsion D | silver 0.80 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.11 |
| ExC-7 | 0.0010 |
| ExC-8 | 0.025 |
| Cpd-2 | 0.023 |
| HBS-1 | 0.10 |
| Gelatin | 0.75 |
| 5th layer (High-speed red-sensitive emulsion layer) | |
| Emulsion E | silver 1.40 |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.095 |
| ExC-3 | 0.040 |
| ExC-6 | 0.020 |
| ExC-8 | 0.007 |
| Cpd-2 | 0.050 |
| HBS-1 | 0.22 |
| HBS-2 | 0.10 |
| Gelatin | 1.20 |
| 6th layer (Interlayer) | |
| Cpd-1 | 0.10 |
| HBS-1 | 0.50 |
| Gelatin | 1.10 |
| 7th layer (Low-speed green-sensitive emulsion layer) | |
| Emulsion A | silver 0.2 |
| Emulsion B | silver 0.2 |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.010 |
| ExM-2 | 0.33 |
| ExM-3 | 0.086 |
| ExY-1 | 0.015 |
| HBS-1 | 0.30 |

-continued

| (Samples 6-1) | |
|---|---|
| HBS-3 | 0.010 |
| Gelatin | 0.73 |
| 8th layer (medium-speed green-sensitive emulsion layer) | |
| Emulsion D | silver 0.80 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.01 |
| ExY-5 | 0.030 |
| HBS-1 | 0.16 |
| HBS-3 | $8.0 \times 10^{-3}$ |
| Gelatin | 0.90 |
| 9th layer (High-speed green-sensitive emulsion layer) | |
| Emulsion E | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.015 |
| ExM-4 | 0.040 |
| ExM-5 | 0.019 |
| Cpd-3 | 0.020 |
| HBS-1 | 0.25 |
| HBS-2 | 0.10 |
| Gelatin | 1.20 |
| 10th layer (Yellow filter layer) | |
| Yellow colloidal silver | silver 0.010 |
| Cpd-1 | 0.16 |
| HBS-1 | 0.60 |
| Gelatin | 0.60 |
| 11th layer (Low-speed blue-sensitive emulsion layer) | |
| Emulsion C | silver 0.25 |
| Emulsion D | silver 0.40 |
| ExS-7 | $8.0 \times 10^{-4}$ |
| ExY-1 | 0.030 |
| ExY-2 | 0.55 |
| ExY-3 | 0.25 |
| ExY-4 | 0.020 |
| ExC-7 | 0.01 |
| HBS-1 | 0.35 |
| Gelatin | 1.30 |
| 12th layer (High-speed blue-sensitive emulsion layer) | |
| Emulsion F | silver 1.38 |
| EXS-7 | $3.0 \times 10^{-4}$ |
| ExY-2 | 0.10 |
| ExY-3 | 0.10 |
| HBS-1 | 0.070 |
| Gelatin | 0.86 |
| 13th layer (1st protective layer) | |
| Emulsion G | silver 0.20 |
| UV-4 | 0.11 |
| UV-5 | 0.17 |
| HBS-1 | $5.0 \times 10^{-2}$ |
| Gelatin | 1.00 |
| 14th layer (2nd protective layer) | |
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition to the above components, to improve storage stability, processability, a resistance to pressure, antiseptic and mildewproofing properties, antistatic properties, and coating properties, the individual layers contained W-1 to W-3, B-4 to B-6, F-1 to F-17, iron salt, lead salt, gold salt, platinum salt, iridium salt, and rhodium salt.

TABLE 6

| Emulsion No. | Average AgI content (%) | Average grain size (μm) | Variation coefficient (%) according to grain size | Diameter/ thickness ratio | Silver amount ratio [Core/intermediate/ shell] | (AgI contnet) | Grain structure/shape |
|---|---|---|---|---|---|---|---|
| Emulsion A | 2 | 0.55 | 25 | 7 | | | Uniform structure tabular grain |
| Emulsion B | 4.5 | 0.65 | 25 | 6 | [12/59/29] | (0/11/8) | Triple structure tabular grain |
| Emulsion C | 3 | 0.45 | 25 | 7 | [10/60/30] | (0/1/8) | Triple structure tabular grain |
| Emulsion D | 2.8 | 0.8 | 18 | 6 | [14/56/30] | (0.2/1/7.5) | Triple structure tabular grain |
| Emulsion E | 2.3 | 1.1 | 16 | 6 | [6/64/30] | (0.2/1/5.5) | Triple structure tabular grain |
| Emulsion F | 13.6 | 1.75 | 26 | 3 | [1/2] | (41/0) | Double structure tabular grain |
| Emulsion G | 1 | 0.07 | 15 | 1 | | | Uniform structure fine grain |

In Table 6, (1) The emulsions A to F were subjected to reduction sensitization during grain preparation by using thiourea dioxide and thiosulfonic acid in accordance with the embodiments in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the embodiments in Japanese Patent Application No. 3-237450.

(3) In the preparation of tabular grains, low-molecular weight gelatin was used in accordance with the embodiments in JP-A-1-158426.

(4) Dislocation lines as described in Japanese Patent Application No. 3-237450 were observed in tabular grains and regular crystal grains having a grain structure when a high-voltage electron microscope was used.

ExC-1

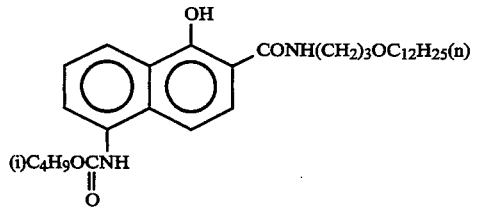

ExC-2

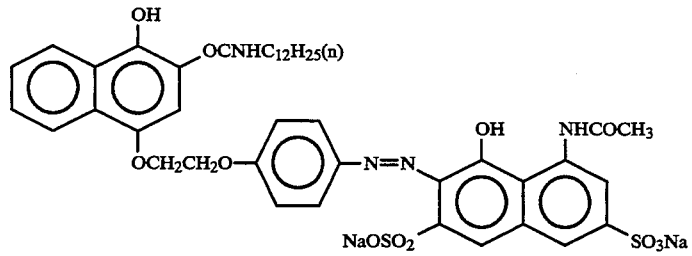

ExC-3

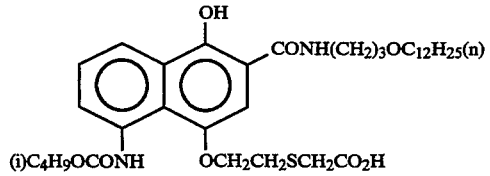

-continued
ExC-4
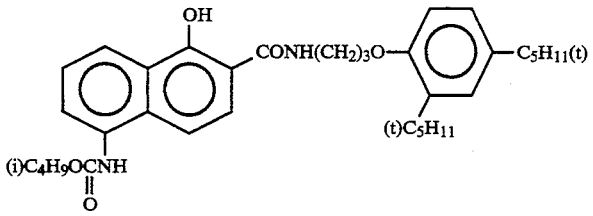
ExC-5
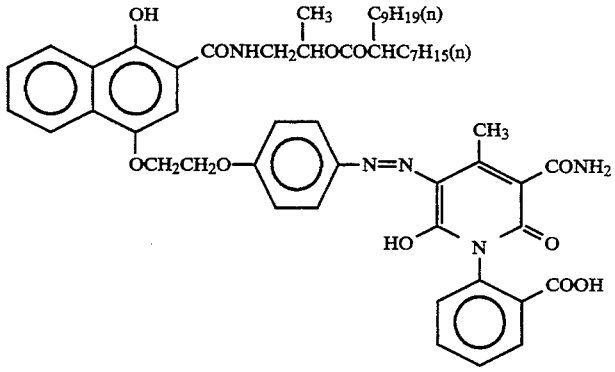
ExC-6
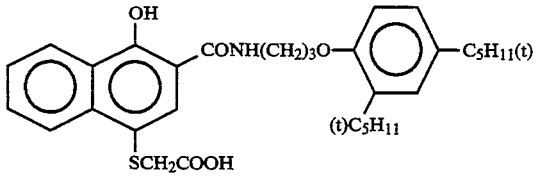
ExC-7
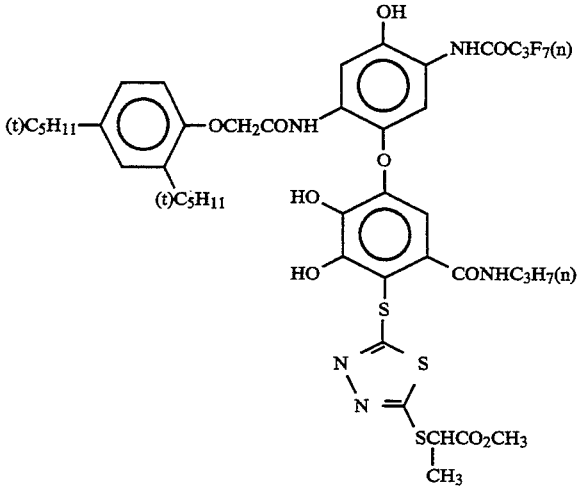
ExC-8
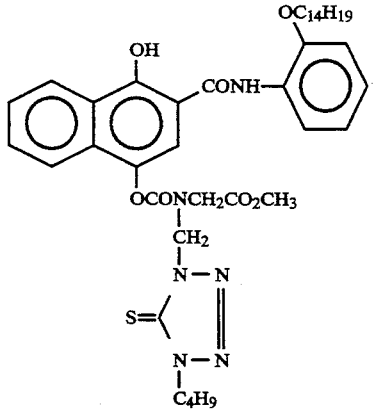

-continued
ExM-1
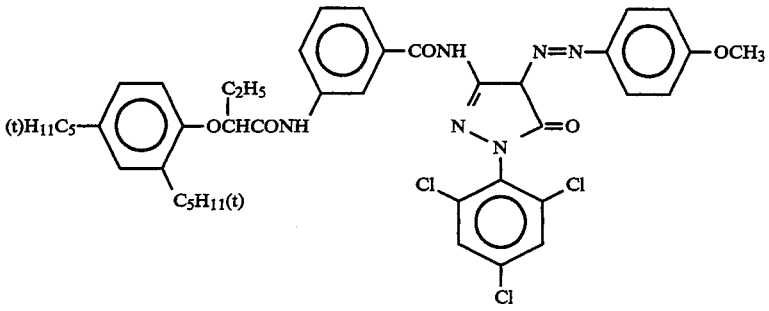
ExM-2
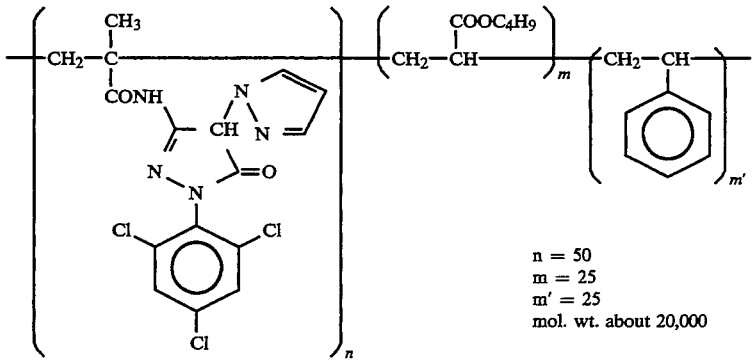
n = 50
m = 25
m' = 25
mol. wt. about 20,000
ExM-3
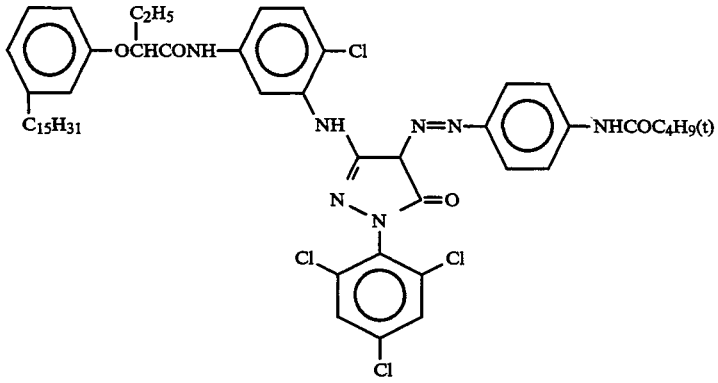
ExM-4
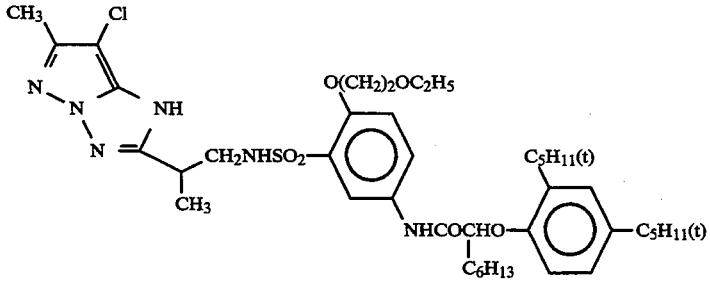

-continued
ExM-5
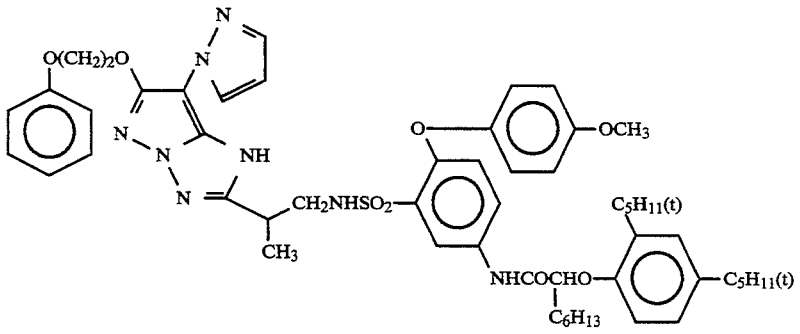
ExY-1
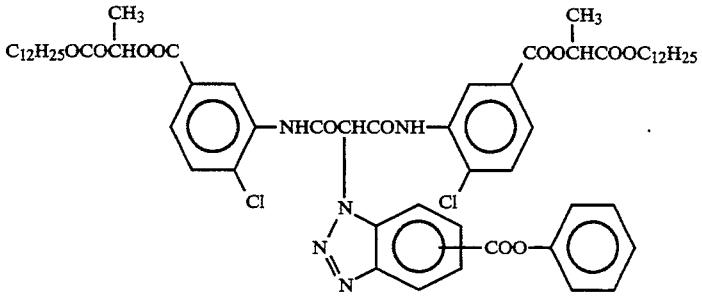
ExY-2
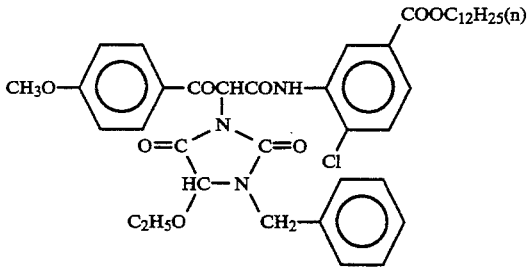
ExY-3
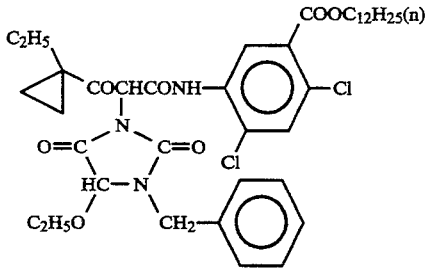
ExY-4
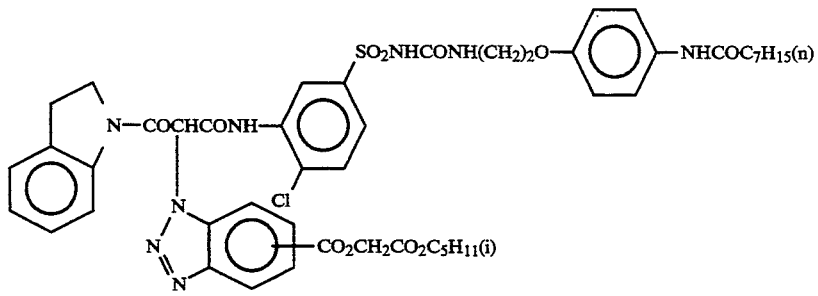

-continued
ExY-5
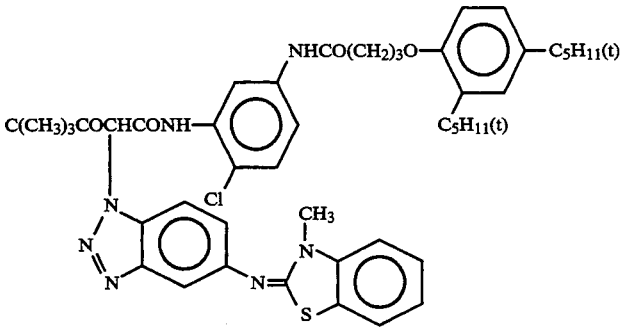
ExF-1
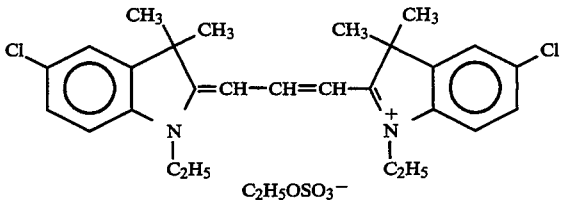
Cpd-1
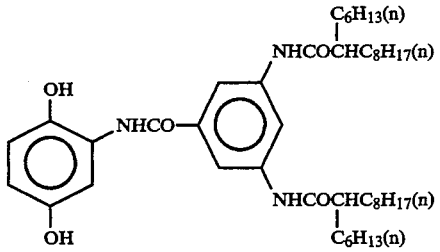
Cpd-2
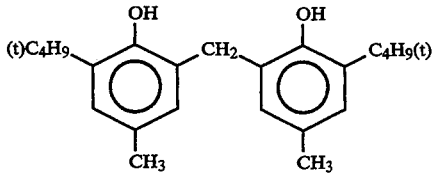
Cpd-3
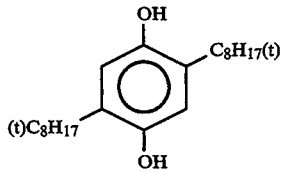
UV-1
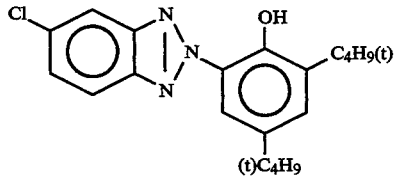
UV-2
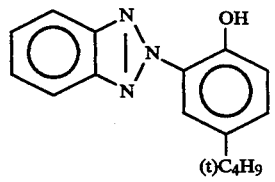

-continued
UV-3
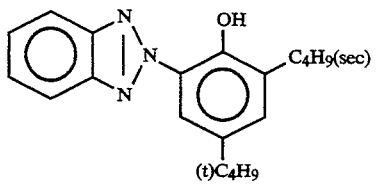
UV-4
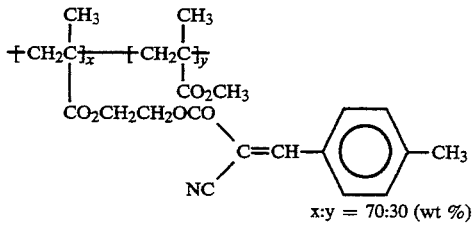
x:y = 70:30 (wt %)
UV-5
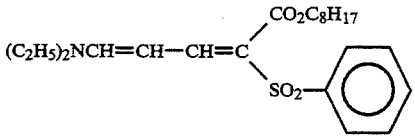
tricresyl phosphate HBS-1
di-n-butyl phtalate HBS-2
HBS-3
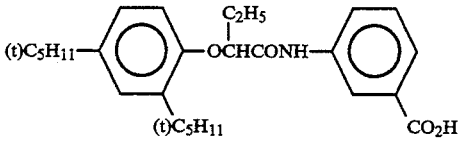
ExS-1
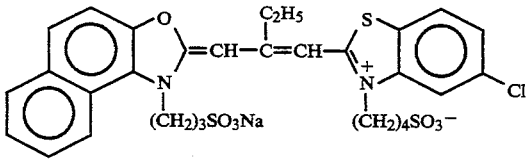
ExS-2
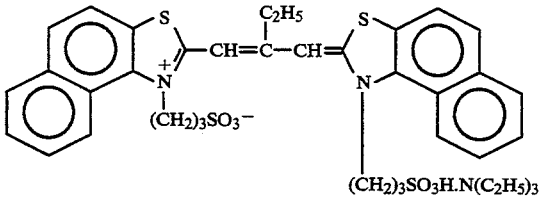
ExS-3
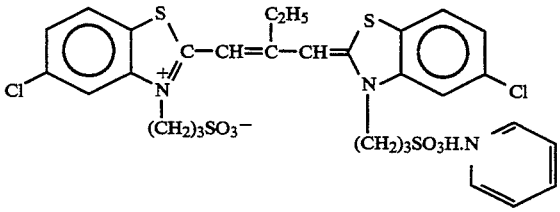
ExS-4
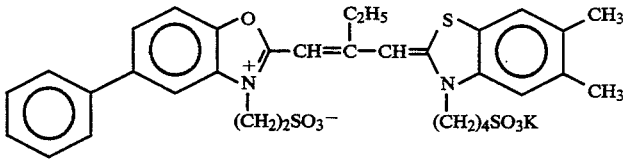

-continued
ExS-5
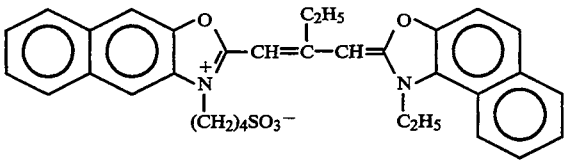
ExS-6
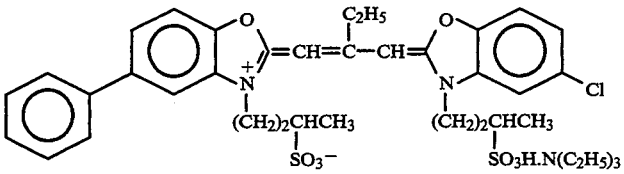
ExS-7
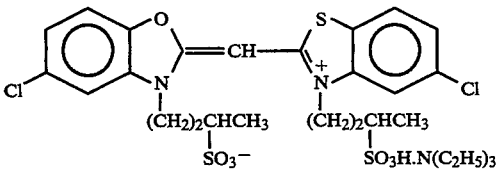
S-1
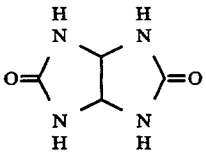
H-1
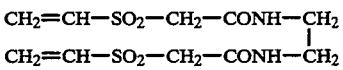
B-1
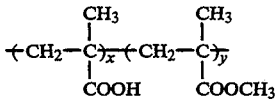
x/y = 10/90
B-2
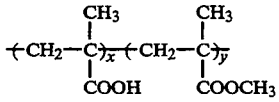
x/y = 40/60
B-3
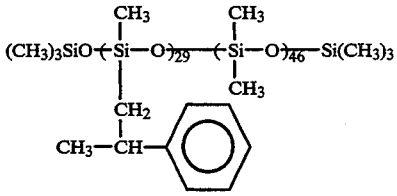
B-4
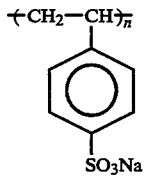
B-5
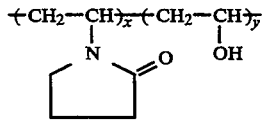
x/y = 70/30

-continued
B-6
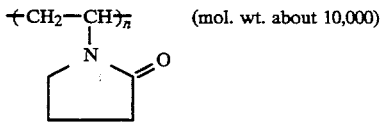
W-1
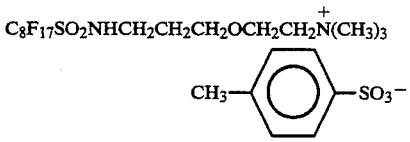
W-2
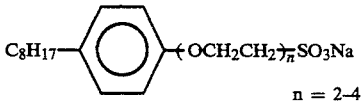
W-3
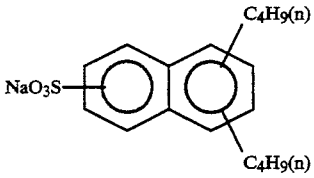
F-1
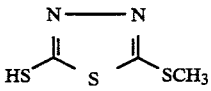
F-2
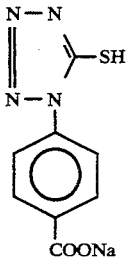
F-3
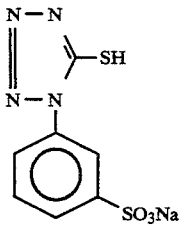
F-4
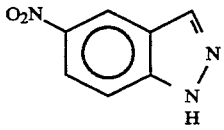
F-5
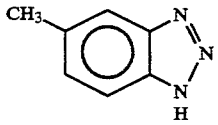
F-6
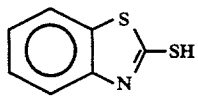

-continued
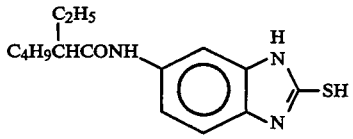
F-7
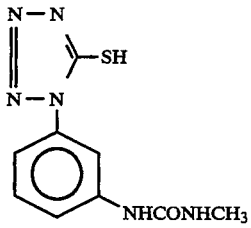
F-8
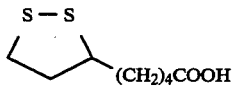
F-9
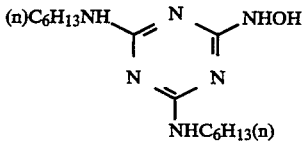
F-10
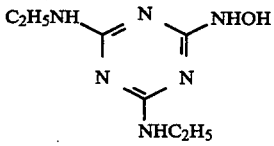
F-11
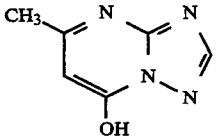
F-12
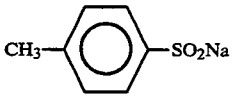
F-13
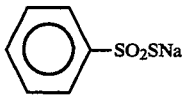
F-14
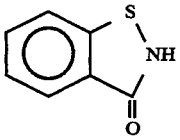
F-15
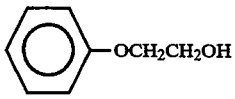
F-16
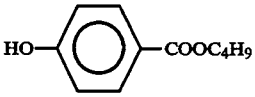
F-17
In addition, three types of emulsions 6A, 6B, and C as shown in Table 7 were prepared following the same procedures as for the emulsion 1E of Example 1. In each of the emulsions 6A and 6B, the substantially perfect cubes accounted for 90% or more of the total projected area. Each emulsion has a silver iodide content of 1.75 mol %.

TABLE 7

| Emulsion No. | Average grain size (μm) | Variation coefficient (%) according to grain size | Perfection ratio |
|---|---|---|---|
| Emulsion 6A | 0.25 | 8 | 0.998 |
| Emulsion 6B | 0.45 | 11 | 0.997 |
| Emulsion 6C | 0.45 | 11 | 0.892 |

A sample 6-2 was made by replacing the emulsions A and B in the 7th layer with the emulsions 6A and 6B, respectively.

Also, a sample 6-3 was made by changing the coating silver amount of each of the emulsions 6A and 6B in the sample 6-2 to 0.14. Furthermore, a sample 6-4 was made by replacing the emulsion 6B in the 7th layer of the sample 6-3 with the emulsion 6C.

These samples were left to stand at a temperature of 40° C. and a relative humidity of 70% for 14 hours, exposed to white light for 1/100 second, and subjected to the color development of Example 1. Note that the color development time was set at 3 minutes and 15 seconds.

The density measurement was performed through a green filter, and a relative sensitivity was obtained from the reciprocal of an exposure amount by which a density of 2.5 was given. In addition, after the uniform exposure by which a density of 2.5 was given and the development were performed, the granularity was measured in accordance with the method described in "The Theory of Photographic Process," Macmillan, page 619.

The results are summarized in Table 8 below.

TABLE 8

| Sample No. | 7th layer: Emulsions used | 7th layer: Coating silver amounts | Sensitivity | Granularity | Remarks |
|---|---|---|---|---|---|
| Sample 6-1 | Emulsion A/Emulsion B | 0.20/0.20 | 100 | 100 | Comparative example |
| Sample 6-2 | Emulsion 6A/Emulsion 6B | 0.20/0.20 | 145 | 67 | Present invention |
| Sample 6-3 | Emulsion 6A/Emulsion 6B | 0.14/0.14 | 103 | 98 | Present invention |
| Sample 6-4 | Emulsion 6A/Emulsion 6C | 0.14/0.14 | 67 | 88 | Emulsion C was comparative example |

As is apparent from Table 8, each silver halide photographic light sensitive material containing the cubic emulsions with high perfection ratios of the present invention has a high sensitivity and a hard contrast while improving its graininess, compared to conventional tabular emulsions or cubic emulsions, and can provide a photographic light-sensitive material excellent in graininess even after silver saving of 70% is performed.

What is claimed is:

1. A silver halide photographic light-sensitive material having at least one silver halide emulsion layer on a support, wherein said silver halide emulsion layer contains a silver halide emulsion in which 50% or more of the total projected area of silver halide grains is occupied by substantially perfect cubic silver halide grains or 50% or more of the total number of all silver halide grains is composed of substantially perfect cubic silver halide grains, wherein said substantially perfect silver halide grains have a perfection ratio of 0.96% or more and are silver bromochloroiodide or silver bromoiodide grains having a silver iodide content of 0.5 mol % or more and a silver chloride content of 3 mol % or less and are spectrally sensitized with sensitizing dyes.

2. The silver halide light-sensitive photographic material according to claim 1, wherein the silver iodide content of said silver halide grains is 1.5 mol % or more.

3. The silver halide light-sensitive photographic material according to claim 1, wherein said silver halide grains do not substantially contain silver chloride.

4. The silver halide light-sensitive photographic material according to claim 1, wherein said substantially perfect silver halide grains are chemically sensitized after spectral sensitization with said sensitizing dyes.

5. The silver halide light-sensitive photographic material according to claim 1, wherein 20% or more, on a silver amount basis of said silver halide grains are grown in the presence of a compound represented by Formula (1) below:

$$\text{-}(A)_x\text{-}(B)_y\text{-} \qquad \text{Formula (1)}$$

wherein A represents a repeating unit derived from an ethylenic unsaturated monomer having at least one basic nitrogen atom, B represents a repeating unit derived from a monomer other than A, and x and y each represent a percentage by weight of each individual component, x representing 0.1 to 100, and y representing 0 to 99.9.

6. The silver halide light-sensitive photographic material according to claim 1, wherein the perfection ratio of the cubic silver halide grains is 0.99 or more.

* * * * *